US010383449B2

(12) United States Patent
White et al.

(10) Patent No.: US 10,383,449 B2
(45) Date of Patent: Aug. 20, 2019

(54) BARRIER BENCH

(71) Applicant: Defenshield, Inc., St. Augustine, FL (US)

(72) Inventors: William Collins White, St. Augustine, FL (US); Jordan William Settle, Altoona, PA (US)

(73) Assignee: Defenshield, Inc., St. Augustine ( * ) Notice: Subject to any disclaimer, the term of this patent is extended or adjusted under 35 U.S.C. 154(b) by 179 days.

(21) Appl. No.: 15/593,978

(22) Filed: May 12, 2017

(65) Prior Publication Data

US 2018/0325266 A1 Nov. 15, 2018

(51) Int. Cl.

| | |
|---|---|
| ***A47C 11/00*** | (2006.01) |
| ***A47C 15/00*** | (2006.01) |
| ***F41H 5/04*** | (2006.01) |
| ***F41H 5/08*** | (2006.01) |
| ***F41H 11/08*** | (2006.01) |
| ***F41H 5/06*** | (2006.01) |
| ***F41H 5/24*** | (2006.01) |
| ***F41H 5/26*** | (2006.01) |

(52) U.S. Cl.

CPC ..... *A47C 11/00* (2013.01); *A47C 15/004* (2013.01); *F41H 5/06* (2013.01); *F41H 5/08* (2013.01); *F41H 5/24* (2013.01); *F41H 5/263* (2013.01); *F41H 11/08* (2013.01); *F41H 5/0407* (2013.01)

(58) Field of Classification Search

CPC ..... A47C 11/00; A47C 11/005; A47C 11/02; A47C 5/12; A47C 13/00; A47C 13/005; A47C 15/004; E04B 1/92; E04B 1/98; E04H 9/04; E04H 9/06; E04H 9/10; E04H 1/1211; F41H 5/00; F41H 5/013; F41H 5/0407; F41H 5/06; F41H 5/08; F41H 5/24; F41H 5/263; F41H 11/08

See application file for complete search history.

(56) References Cited

U.S. PATENT DOCUMENTS

| | | | |
|---|---|---|---|
| 772,055 | A | 10/1904 | Post |
| 1,253,964 | A | 1/1918 | Hack |
| 1,261,518 | A | 4/1918 | Hahre |
| 1,274,721 | A | 8/1918 | Krzan |
| 1,281,400 | A | 10/1918 | Larnell |
| 1,327,464 | A | 1/1920 | Dewick et al. |
| 1,465,042 | A | 8/1923 | Hruska |

(Continued)

FOREIGN PATENT DOCUMENTS

| | | | |
|---|---|---|---|
| DE | 64291 C | 2/1892 | |
| DE | 1554165 A1 * | 11/1969 | ..... A47C 11/00 |

(Continued)

*Primary Examiner* — Ryan D Kwiecinski

(74) *Attorney, Agent, or Firm* — Condo Roccia Koptiw LLP

(57) ABSTRACT

A bench that serves as a barrier from ballistics and explosions is disclosed. The bench serves the traditional role of providing a seating area while also providing protection from ballistics and explosions originating from an opposite side of the barrier bench. The bench may comprise one or more panels or plates and an upper wall that are adapted to repel ballistics and blasts. The barrier bench further comprises a series of interconnected members that together form a frame which serves to position the one or more panels and upper wall in a relatively upright position so as to form a barrier against ballistics and explosion blasts.

20 Claims, 24 Drawing Sheets

(56) References Cited

U.S. PATENT DOCUMENTS

| | | | | |
|---|---|---|---|---|
| 1,875,488 | A | 9/1932 | Peters | |
| 2,370,596 | A | 2/1945 | Wallace | |
| 2,613,243 | A | 10/1952 | Frear | |
| 2,845,153 | A | 7/1958 | West | |
| 2,878,054 | A | 3/1959 | Linder | |
| 2,937,602 | A | 5/1960 | Norries | |
| 2,985,174 | A | 5/1961 | Guth | |
| 3,039,161 | A | 6/1962 | Gagnon | |
| 3,590,685 | A | 7/1971 | Lane | |
| 3,712,005 | A | 1/1973 | Eschbach et al. | |
| 3,942,598 | A | 3/1976 | Council | |
| 3,994,243 | A | 11/1976 | Anders | |
| 4,018,016 | A * | 4/1977 | Zale | E04H 1/1211 403/230 |
| 4,030,219 | A | 6/1977 | Donovan | |
| 4,061,093 | A | 12/1977 | Carstens, Jr. et al. | |
| 4,245,546 | A | 1/1981 | Chaires | |
| 4,351,558 | A | 9/1982 | Mueller | |
| 4,416,485 | A | 11/1983 | Long | |
| 4,674,394 | A | 6/1987 | Martino | |
| 4,781,101 | A | 11/1988 | Zevuluni et al. | |
| 4,901,964 | A | 2/1990 | McConnell | |
| 4,949,490 | A | 8/1990 | Miller | |
| 4,953,820 | A | 9/1990 | Yoder | |
| 5,244,172 | A | 9/1993 | Allega | |
| 5,293,807 | A | 3/1994 | Hajdu | |
| 5,368,904 | A | 11/1994 | Stephinson | |
| 5,419,479 | A | 5/1995 | Evels et al. | |
| 5,438,908 | A | 8/1995 | Madden, Jr. | |
| 5,560,149 | A | 10/1996 | Lafevre | |
| 5,641,934 | A | 6/1997 | Follett | |
| 5,666,773 | A | 9/1997 | Librande et al. | |
| 5,703,316 | A | 12/1997 | Madden, Jr. | |
| 5,722,642 | A * | 3/1998 | Bradshaw | A47C 11/00 256/1 |
| 5,829,653 | A | 11/1998 | Kaiser | |
| 5,857,730 | A | 1/1999 | Korpi et al. | |
| 5,878,519 | A | 3/1999 | Huyck et al. | |
| 5,953,820 | A | 9/1999 | Vasudeva | |
| 6,000,347 | A | 12/1999 | Madden, Jr. | |
| 6,116,326 | A | 9/2000 | Domina et al. | |
| 6,170,379 | B1 | 1/2001 | Taylor | |
| 6,333,085 | B1 | 12/2001 | Emek | |
| 6,447,067 | B1 * | 9/2002 | Williams | A47C 4/021 297/184.11 |
| 6,622,607 | B1 * | 9/2003 | Miller | F41H 5/06 2/2.5 |
| 6,907,811 | B2 | 6/2005 | White | |
| 6,962,461 | B2 | 11/2005 | Choi et al. | |
| 7,069,680 | B1 | 7/2006 | Crawford | |
| 7,104,720 | B2 | 9/2006 | Humphries et al. | |
| 7,128,308 | B2 | 10/2006 | Marsh et al. | |
| 7,520,207 | B1 | 4/2009 | Fuqua et al. | |
| 7,849,781 | B2 | 12/2010 | White | |
| 7,891,283 | B2 | 2/2011 | Kleniatis et al. | |
| 8,726,782 | B2 | 5/2014 | White | |
| 9,670,631 | B2 * | 6/2017 | Ditta | E01F 13/022 |
| 2003/0167911 | A1 * | 9/2003 | White | F41H 5/06 89/36.07 |
| 2004/0255769 | A1 | 12/2004 | Drackett | |
| 2005/0265780 | A1 | 12/2005 | Humphries et al. | |
| 2008/0271652 | A1 * | 11/2008 | White | E01F 13/12 109/49.5 |
| 2016/0238349 | A1 * | 8/2016 | White | F41H 5/24 |
| 2017/0156504 | A1 * | 6/2017 | Muegerl | A47C 11/00 |
| 2017/0224120 | A1 * | 8/2017 | Georgiadis | A47C 11/00 |
| 2018/0027958 | A1 * | 2/2018 | White | A47B 19/00 |

FOREIGN PATENT DOCUMENTS

| | | | | |
|---|---|---|---|---|
| DE | 2412568 | | 9/1975 | |
| FR | 462049 | | 1/1914 | |
| FR | 2607238 | | 5/1988 | |
| JP | 2750279 | B2 * | 5/1998 | A47C 7/66 |
| WO | WO 94/029665 | | 12/1994 | |
| WO | WO-2007034047 | A2 * | 3/2007 | A47C 7/66 |
| WO | WO 09/048650 | | 4/2009 | |

* cited by examiner

102

102

102

BARRIER BENCH

BACKGROUND

There is a need for barriers behind which persons can position themselves for protection from ballistics, explosions, and harmful projectiles. In traditionally hostile environments such as war zones, soldiers often dig fox holes or trenches, or utilize natural bunkers for protection. Unfortunately, the threat of harm from gun fire and explosions now exists in areas and settings that previously were considered to be safe from such life-threatening dangers. Residential and commercial areas have, unfortunately, become the setting for deadly gunfire and explosions. In these and other settings, natural barrier formations may not exist, and it is not practicable or suitable to utilize traditional means of protection such as trenches or fox holes.

SUMMARY

Applicant discloses a bench that serves as a seating area but also provides protection against gun fire and explosions. The bench, which may be referred to as a barrier bench or an armored bench, protects an area on a protected side of the barrier bench from projectiles originating from an attack side of the barrier bench that is opposite the protected side.

In an example embodiment, the barrier bench comprises at least one backrest panel, which may be an armored panel, and an upper wall that extends upward from the backrest panel. The backrest panel and the upper wall define a first side and a second side opposite the first side. The backrest panel and upper wall are configured to prevent a projectile traveling in a first direction that strikes the first side from penetrating through to the second side.

In an example embodiment, the barrier bench comprises a frame adapted to position the backrest panel in a substantially upward direction relative to a base surface on which the barrier bench rests. In an example embodiment, the frame comprises a first side member that extends in a second direction substantially perpendicular to the base surface and which is configured to contact the base surface in order to support the barrier bench upon the base surface. The frame comprises a second side member that is spaced apart from the first side member along a third direction that is substantially perpendicular to both the first direction and the second direction. The second side member, like the first side member, is configured to contact the base surface and thereby support the barrier bench upon the base surface. A seat member is configured to be attached to both the first and second side members. The seat member forms a plane substantially parallel with respect to the base surface upon which the barrier bench is positioned and is adapted to support a load equivalent to the weight of at least one or more persons.

The frame further comprises a bottom channel member positioned between the first side member and the second side member. In an example embodiment, the bottom channel member comprises a first wall, a second wall, and a base wall that extends between the first and second walls. The first wall is spaced from the second wall so as to define a gap that is configured to receive the backrest panel such that movement of the armored backrest panel along the first direction is blocked by the first and second walls. Movement of the backrest panel along the second direction toward the base surface is blocked by the base wall of the bottom channel member.

In an example embodiment, the frame may still further comprise a support structure that is formed between, and rigidly attached to, the first side wall and the second side wall. The support structure may comprise one or more horizontally and/or vertically arranged members positioned between the first side member and the second side member. The bottom channel member may be attached to the support structure. The backrest panel is positioned to abut the support structure when a portion of the backrest panel is positioned in the bottom channel member. In an example embodiment, the support structure is disposed at an angle relative to the base surface so that the panel is urged by gravitational forces to abut or lean against the support structure.

In an example embodiment, the barrier bench frame further comprises a support member secured relative to the backrest panel and adapted to receive at least a portion of the upper wall. The upper wall abuts the support member and extends upward relative to the support member and the supporting surface. The barrier bench frame may also comprise a first side channel secured to the first side member and second side channel secured to the second side member. The first and second side channels each extend away from the supporting surface and beyond the upper edge of the backrest panel. The upper wall is received in the first and second side channels and abuts the support member so as to be secured relative to the backrest panel. In an example embodiment, at least a portion of the upper wall extends above an upper edge of the backrest panel and at least a portion of the upper wall extends below the upper edge of the backrest panel.

This Summary is provided to introduce a selection of concepts in a simplified form that are further described below in the Detailed Description. This Summary is not intended to identify key features or essential features of the claimed subject matter, nor is it intended to be used to limit the scope of the claimed subject matter. Other features are described below.

BRIEF DESCRIPTION OF DRAWINGS

The following description of the illustrative embodiments may be better understood when read in conjunction with the appended drawings. It is understood that potential embodiments of the disclosed systems and methods are not limited to those depicted.

DETAILED DESCRIPTION

Applicant discloses herein a bench that is constructed to serve as a barrier from ballistics and explosions. The bench, which may be referred to as a barrier bench, serves the traditional role of providing a seating area while also providing protection from ballistics and explosions originating from an opposite side of the barrier bench. The barrier bench may comprise one or more panels or plates that are adapted to repel ballistics and blasts. The barrier bench further comprises a series of interconnected members that together form a frame which serves to position the one or more panels in a relatively upright position so as to form a barrier against ballistics and explosion blasts. The barrier bench also comprises an upper wall that extends upward beyond the one or more panels. The one or more panels and upper wall define a first side and a second side opposite the first side. The one or more panels and upper wall are configured to prevent a projectile traveling in a first direction that strikes the first side from penetrating through to the second side.

Figure 1:
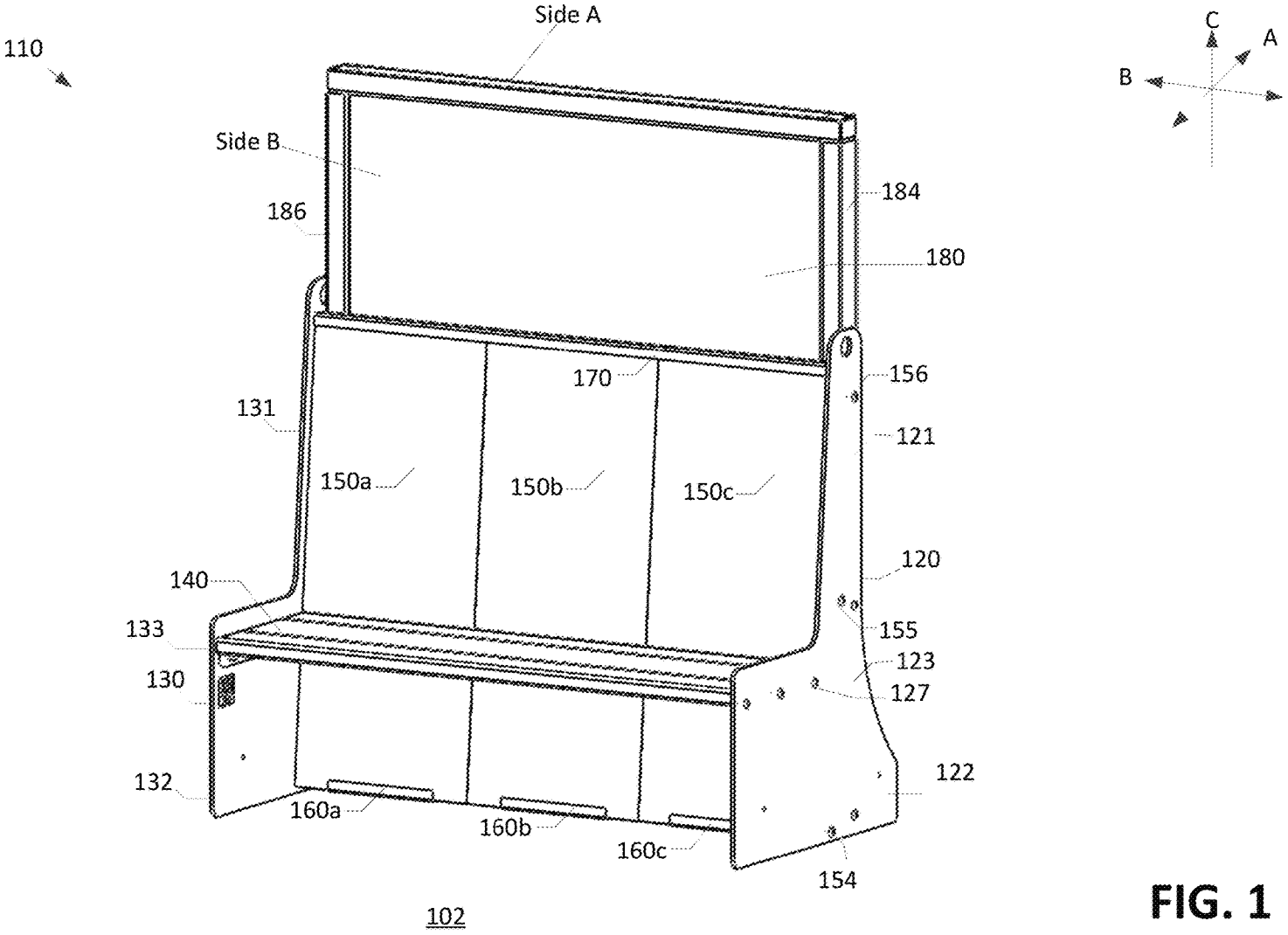
FIG. 1 depicts a front perspective view of an example barrier bench.
Figure 2:
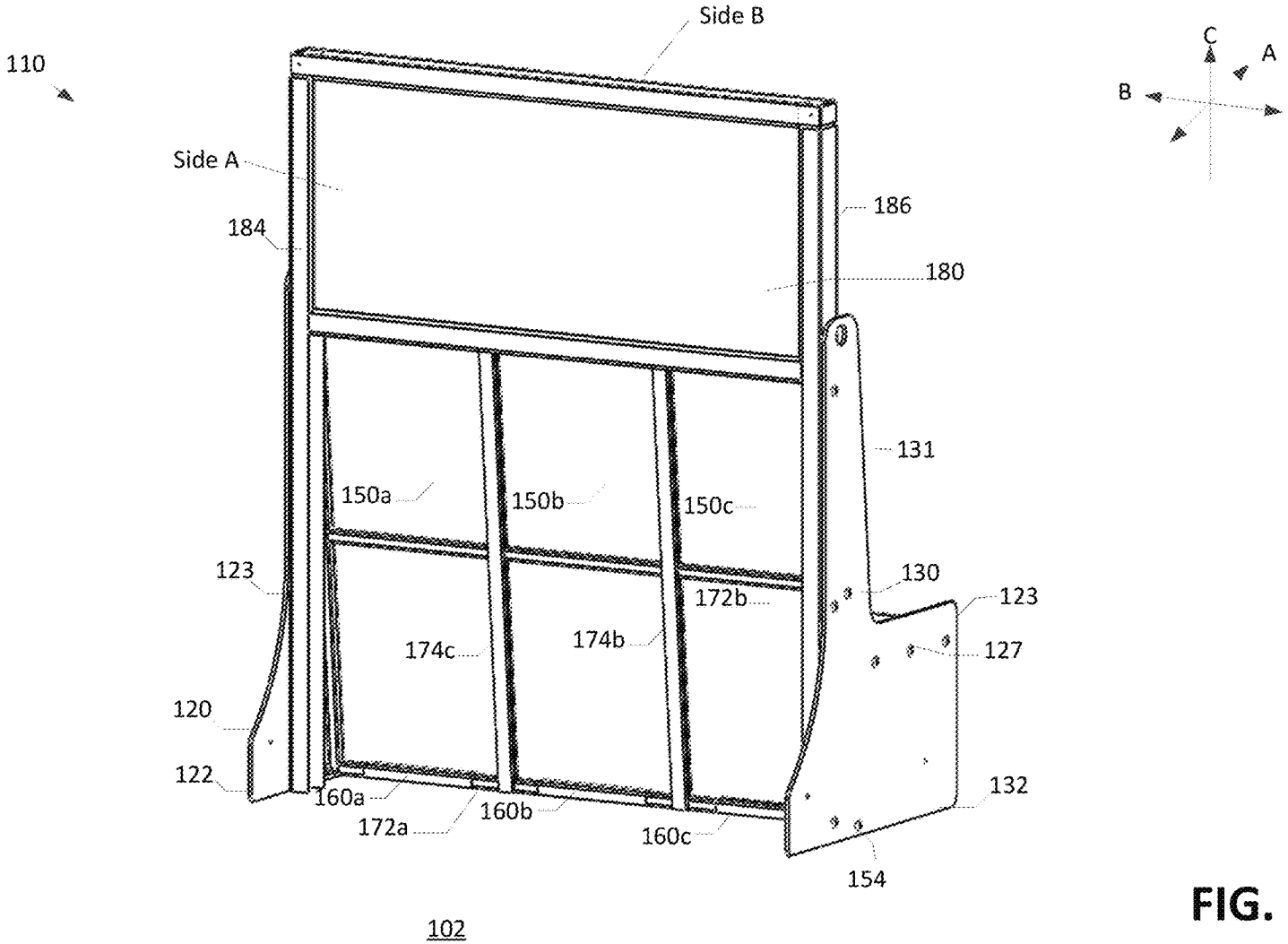
FIG. 2 depicts a rear perspective view of an example barrier bench.

FIG. 1 depicts a front perspective view of an example barrier bench 110. FIG. 2 depicts a rear perspective view of an example barrier bench 110. As shown, in an example embodiment, barrier bench 110 comprises a plurality of backrest panels 150*a-c* that are positioned in relatively upward direction (direction C as noted in FIG. 1) relative to base surface 102. Backrest panels 150*a-c* are held in place by a series of interconnected members that together form a frame. In an example embodiment, the frame may comprise first side member 120, second side member 130, seat member 140, and a plurality of bottom channel members 160. Each of side members 120 and 130 extends in an upwardly direction (direction C) from, and substantially perpendicular to base surface 102. Side members 120 and 130 are configured to rest upon the base surface and thereby support barrier bench 110. Each of side members 120 and 130 comprises an upper portion (121, 131), a lower portion (122, 132), and an intermediate portion (123, 133). Lower portions 122, 132 may be configured with lower extensions projecting therefrom for interfacing with the base surface 102. The lower extensions may have recesses formed there between that provide clearance and thereby adapt first and second side members 120 and 130 for use on uneven surfaces. In an example embodiment, lower extensions 122 and 132 may have feet attached thereto or formed therewith. The feet may have apertures or openings therein that are adapted to receive a member such as, for example, a screw or spike, suitable for securing side members 120, 130 to base surface 102. Side members 120 and 130 may be formed from any suitable material. In an example embodiment, side members 120 and 130 may be armored and may be formed from a ballistic resistant material such as ballistic resistant metal, masonry, and/or carbon fiber.

Side members 120 and 130 are spaced apart from each other along a direction (designated direction B) that is substantially perpendicular to the upwardly direction C from supporting surface 102. Side members 120 and 130 are configured to interface with and support seat member 140. Any suitable mechanism may be employed to secure seat member 140 relative to side members 120 and 130. In an example embodiment, side members 120 and 130 have one or more apertures formed therein adapted to receive bolts 127, 137 or similar mechanisms that extend through the apertures and through aligned apertures formed in seat member 140. In an example embodiment, the apertures are formed in middle portions 123 and 133 of side members 120 and 130. Bolts may be secured relative to side members 120 and 130 and seat member 140 using any suitable fastening means such as, for example, one or more wing nuts. Seat member 140 forms a seating area adapted to support a load equivalent to at least the weight of one or more persons. Seat member 140 may be formed in a plane substantially parallel with respect to surface 102 on which barrier bench 110 is positioned. Seat member 140 may be formed of any suitable material and may be formed, for example, from ballistic resistant material such as metal, masonry, and/or carbon fiber.

One or more backrest panels 150*a-c* extend in a substantially upward direction (direction C) relative to the supporting surface 102 and are positioned between first side member 120 and second side member 130. In an example embodiment, backrest panels 150*a-c* extend from proximate the supporting surface 102 to a height proximate that of upper portion 121, 131 of side members 120, 130. Each of backrest panels 150*a-c* have a first side (designated side A) and a second side (designated side B) opposite the first side with respect to a direction designated direction A in the FIGs. Each of backrest panels 150*a-c* is configured to prevent projectiles that strike the first side of the panel from penetrating through to the second side. In an example embodiment, backrest panels 150*a-c* may be armored panels formed from materials such as metal, masonry, and/or carbon fiber capable of withstanding ballistics and blast projectiles.

Backrest panels 150*a-c* are positioned so as to prevent projectiles from passing from the first side (side A) of barrier bench 110 to the opposite side (side B) of barrier bench 110. Backrest panels 150*a-c* are arranged side-by-side in the space between side panels 120 and 130 and thereby create a unified boundary to block projectiles. In an example embodiment, armored strips may be placed in the areas where backrest panels 150*a-c* meet or abut each other and abut side members 120 and 130. Such strips may overlap the edges of backrest panels 150*a-c* and thereby provide additional protection in the areas where backrest panels 150*a-c* meet each other and abut side members 120 and 130.

In an example embodiment, the frame of barrier bench 110 may further comprise one or more bottom channel members 160*a-c* which may be positioned between first side member 120 and second side member 130 and which are secured relative to side members 120 and 130. In an example embodiment, lower bottoms of bottom channel members 160*a-c* are positioned at or proximate a height equivalent to that of lower portions 122, 132 of side members 120, 130. In an example embodiment, each of bottom channel members 160*a-c* may comprise a first wall, a second wall, and a base wall that extends between the first wall and the second wall. The base wall may be positioned proximate base surface 102 on which barrier bench 110 may stand. The first wall and the second wall are spaced apart from each other so as to define a gap or channel that is configured to receive one or more of backrest panels 150*a-c*. Each channel member may comprise a mounting bracket that is adapted to be mounted on a horizontal bar of a support structure. When the mounting bracket is hung on or mounted to the support structure, the channel member is positioned to receive a backrest panel 150*a-c*.

In an example embodiment, three bottom channel members 160*a*, 160*b*, and 160*c* are distributed across the area between first side member 120 and second side member 130. Each of bottom channel members 160*a-c* receives a corresponding one of backrest panels 150*a-c*. When a backrest panel 150*a* is positioned in bottom channel member 160*a*, movement of the panel relative to other portions of barrier bench 110 may be limited or restricted in some directions. For example, movement of backrest panel 150*a* in a direction substantially parallel to base surface 102 and substantially perpendicular to the channel or gap formed by the first and second walls of bottom channel member 160*a* may be restricted. In other words, with respect to FIG. 1, movement of backrest panel 150*a* in direction A may be blocked, limited, or restricted by the two opposing side walls of bottom channel member 160*a*. Movement of backrest panel 150*a* toward the supporting surface 102 may be blocked or restricted by the base wall of the channel formed by bottom channel member 160*a*. Movement of backrest panel 150*a* in an upward direction (direction C) away from the base wall of bottom channel member 160*a* and substantially perpendicular to base surface 102 may not be limited by bottom channel member 160*a*, although movement in the upward direction may be limited by upper channel 170 as discussed below. In an example embodiment, movement of backrest panel 150*a* in a direction parallel to and along a channel formed by bottom channel member 160*a* may not be restricted by bottom channel member 160*a*. However, movement of backrest panel 150*a* in the direction parallel to and along the channel formed by bottom channel member 160*a* may be restricted by interference with second side member 130 in one direction and by an adjacent backrest panel 150*b* in the other direction. Likewise, movement of adjacent backrest panel 150*b* is blocked or restricted by backrest panels 150*a* and 150*c*. Movement of backrest panel 150*c* is limited or blocked by adjacent backrest panel 150*b* and side member 120. Accordingly, movement of backrest panels 150*a-c* in direction B along bottom channel members 160*a-d* may be blocked by adjacent panels and side members 120 and 130. Bottom channel members 160*a-c* may be formed from any suitable material. In an example embodiment, bottom channel members 160*a-c* may be formed from a ballistic resistant material such as, for example, steel, masonry, and/or carbon fiber.

In an example embodiment, the frame of barrier bench 110 for positioning backrest panels 150*a-c* may further comprise an upper channel 170. Upper channel 170 may comprise at least a first wall, a second wall, and a base wall. The first wall and second wall are spaced apart and connected by the base wall so as to form a gap configured to receive therein a portion of one or more of panels 150*a-c*. The gap formed by the upper channel 170 is positioned opposite and faces the one or more gaps formed by the bottom channel members 160*a-c*. In an example embodiment, upper channel 170 extends from first side member 120 to second side member 130 and is secured relative to side members 120 and 130. Upper channel 170 may be affixed to side members 120 and 130 and/or may be affixed to support structure 152 described below. Upon a portion of one or more backrest panels 150*a-c* being positioned in upper channel 170, movement of the particular panel may be limited or restricted in some directions. For example, movement of backrest panel 150*a* in a direction substantially parallel to base surface 102 and substantially perpendicular to the channel or gap formed by the first and second walls of channel member 170 may be restricted. In other words, with respect to FIG. 1, movement of backrest panel 150*a* in direction A may be blocked, limited, or restricted by the two opposing side walls of channel member 170. Movement of backrest panel 150*a* away from supporting surface 102 may be blocked or restricted by a base wall of the channel formed by bottom channel member 170. Movement of backrest panel 150*a* in the direction parallel to and along the channel formed by bottom channel member 170 may be restricted by interference with second side member 130 in one direction and by an adjacent backrest panel 150*b* in the other direction. Upper channel 170 may be formed from any suitable material. In an example embodiment, upper channel 170 may be formed from a ballistic resistant material such as, for example, steel, masonry, and/or carbon fiber. It will be appreciated that while upper channel 170 is depicted as comprising a single component, upper channel 170 may comprise a plurality of components that operate in a manner similar to that discussed.

Barrier bench 110 further comprises an upper wall 180. Upper wall 180 extends in a substantially upward direction (direction C) relative to the supporting surface 102 and is positioned between first side member 120 and second side member 130. In an example embodiment, upper wall 180 abuts and extends upward from support member 182 which is positioned proximate the upper portion of backrest panels 150*a-c*. Support member 182 prevents or limits movement of upper wall 180 toward the supporting surface. At least a portion of upper wall 180 is received into side channels 184 and 186. Side channels 184 and 186 limit movement of the upper wall 180 in directions A and B. Upper wall 180 is configured to prevent projectiles that strike a first side of upper wall 180 from penetrating through to the second side. Upper wall 180 is positioned so as to prevent projectiles from passing from the first side (side A) of barrier bench 110 to the opposite side (side B) of barrier bench 110. In an example embodiment, upper wall 180 overlaps with backrest panels 150*a-c*. For example, a lower portion of upper wall 180 may be positioned vertically at a position closer to the supporting surface than the upper edge or portion of backrest panels 150*a-c*. Upper wall 180 in combination with backrest panels 150*a-c* thereby create a unified boundary to block projectiles. In an example embodiment, upper wall 180, side channels 184 and 186, and support member 182 may be formed from a ballistic resistant material such as, for example, steel, masonry, and/or carbon fiber. In an example embodiment, all or a portion of upper wall 180 may be formed from a transparent or semitransparent material that allows a person to view objects and people on the opposing side of upper wall 180. For example, all or a portion of upper wall 180 may be formed from ballistic resistant glass. In another example embodiment, all of upper wall 180 may be formed from ballistic resistant material that is not transparent. For example, all of upper wall 180 may be formed from non-transparent ballistic resistant metal. It will be appreciated that while upper wall 180 may comprise a single component, upper wall 180 may comprise a plurality of components that operate in a manner as described.

Figure 3:
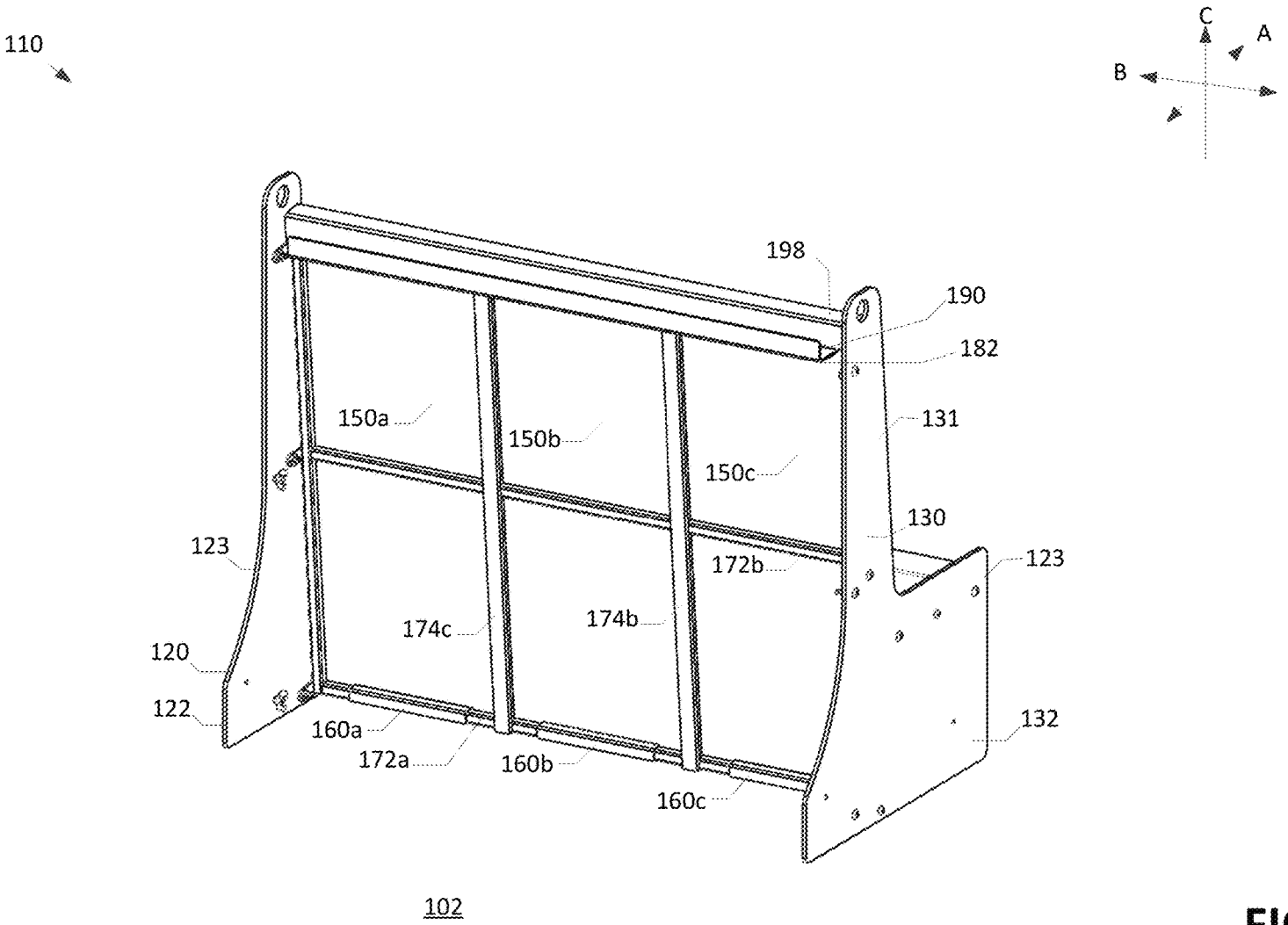
FIG. 3 depicts a rear perspective view of a partially assembled example barrier bench.

FIG. 3 depicts a rear perspective view of a partially assembled example barrier bench 110. In the embodiment depicted in FIG. 3, upper wall 180 and side channels 184 and 186 are not illustrated for purposes of explanation. As shown in FIG. 3, support member 182 is positioned proximate, and secured relative to, a side of backrest panels 150*a-c*. In an example embodiment, support member 182 may comprise a first portion that is attached to or forms an interference fit with backrest panels 150*a-c* and second portion for receiving a portion of upper wall 180. At least a portion of support member 182 is positioned below a top portion or edge of backrest panels 150*a-c*. In an example embodiment, support member 182 forms a support channel 190 which is adapted to receive a portion of upper wall 180 therein. In an example embodiment, the support channel 190 comprises a bottom portion upon which at least a portion of upper wall 180 rests. The bottom portion is positioned vertically closer to the supporting surface than a top portion or edge of backrest panels 150*a-c*. Accordingly, when upper wall 180 is received in support channel 190, at least a portion of upper wall 180 is positioned vertically below an upper edge or portion of backrest panels 150*a-c*.

Figure 4:
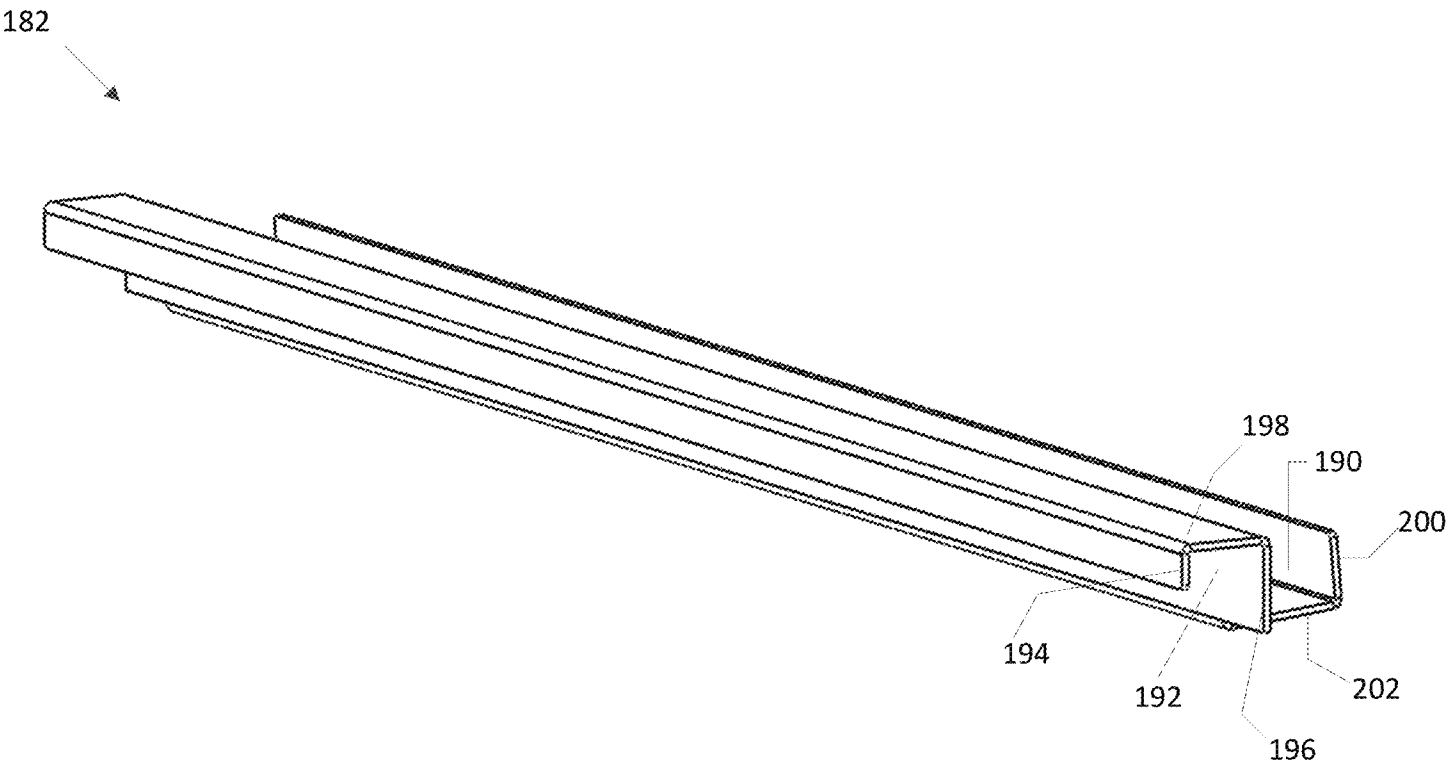
FIG. 4 depicts an isolated perspective view of a support member.

FIG. 4 provides an isolated perspective view of an example embodiment of support member 182. As shown, support member 182 may comprise support channel 190 and retaining channel 192. Retaining channel 192 is formed by a first wall 194, a second wall 196 and a base wall 198 that extends therebetween. Support channel 190 is formed by wall 196, a second wall 200, and a base wall 202 extending therebetween. Retaining channel 192 is positioned opposite support channel 190. Retaining channel 192 is adapted to receive an upper edge of backrest panels 150*a-c*. When retaining channel 192 is positioned on backrest panels 150*a-c*, support channel 190 is positioned below the upper edge of the panels 150*a-c*. Accordingly, when retaining channel 192 is positioned on backrest panels 150*a-c*, at least a portion of upper wall 180 received in support channel 190 is positioned below the upper portion or edge of panels 150*a-c*.

Figure 5:
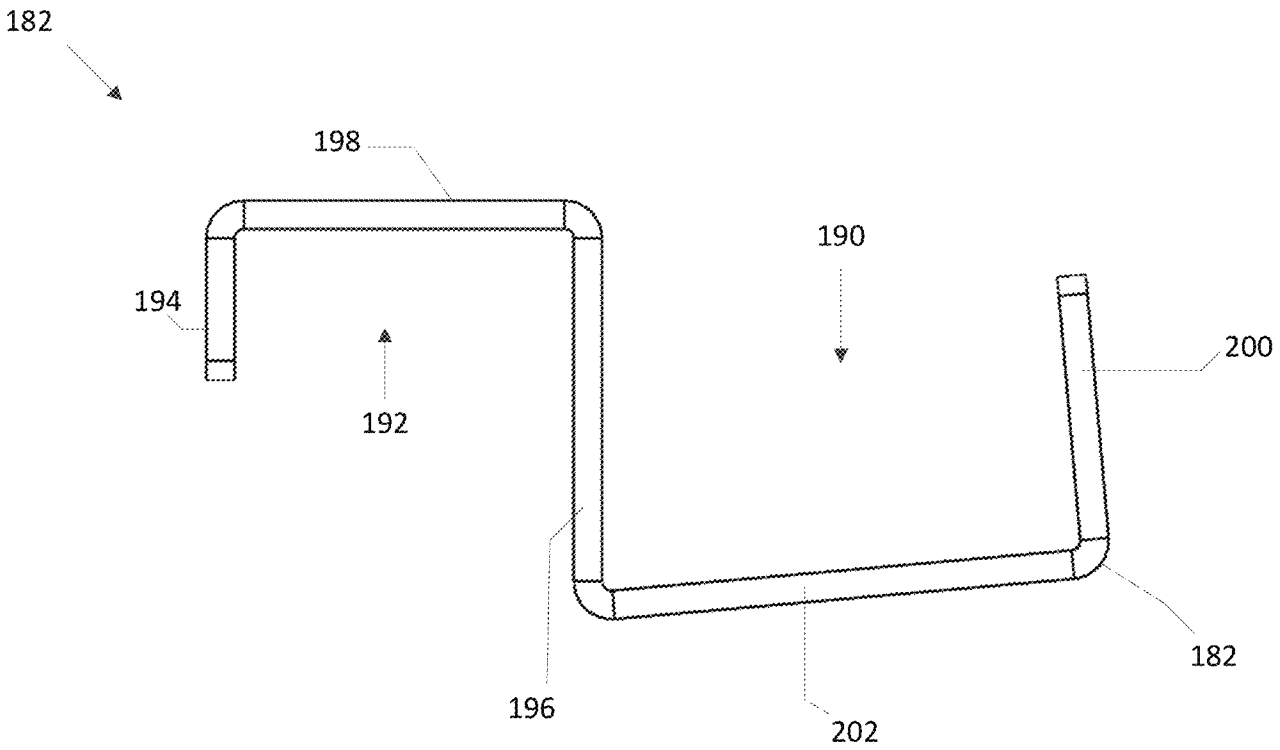
FIG. 5 depicts an isolated sectional view of a support member.

FIG. 5 provides a side view of an example embodiment of support member 182. In the example embodiment, bottom wall 198 of retaining channel 192 abuts or interfaces with an upper edge of backrest panels 150*a-c*. Bottom wall 202 of support channel 190 abuts or interfaces with a portion of upper wall 180. As shown, bottom wall 198 is formed at an angle relative to bottom wall 202. The angular difference between wall 198 of retaining channel 192 and wall 202 of support channel 190 allows for support member 182 to be applied to backrest panels 150*a-c* that are formed at an angle relative to the desired position for upper wall 180. For example, backrest panels 150*a-c* may extend at an angle relative to the supporting surface, but the upper wall may extend substantially perpendicular to the supporting surface.

Figure 6:
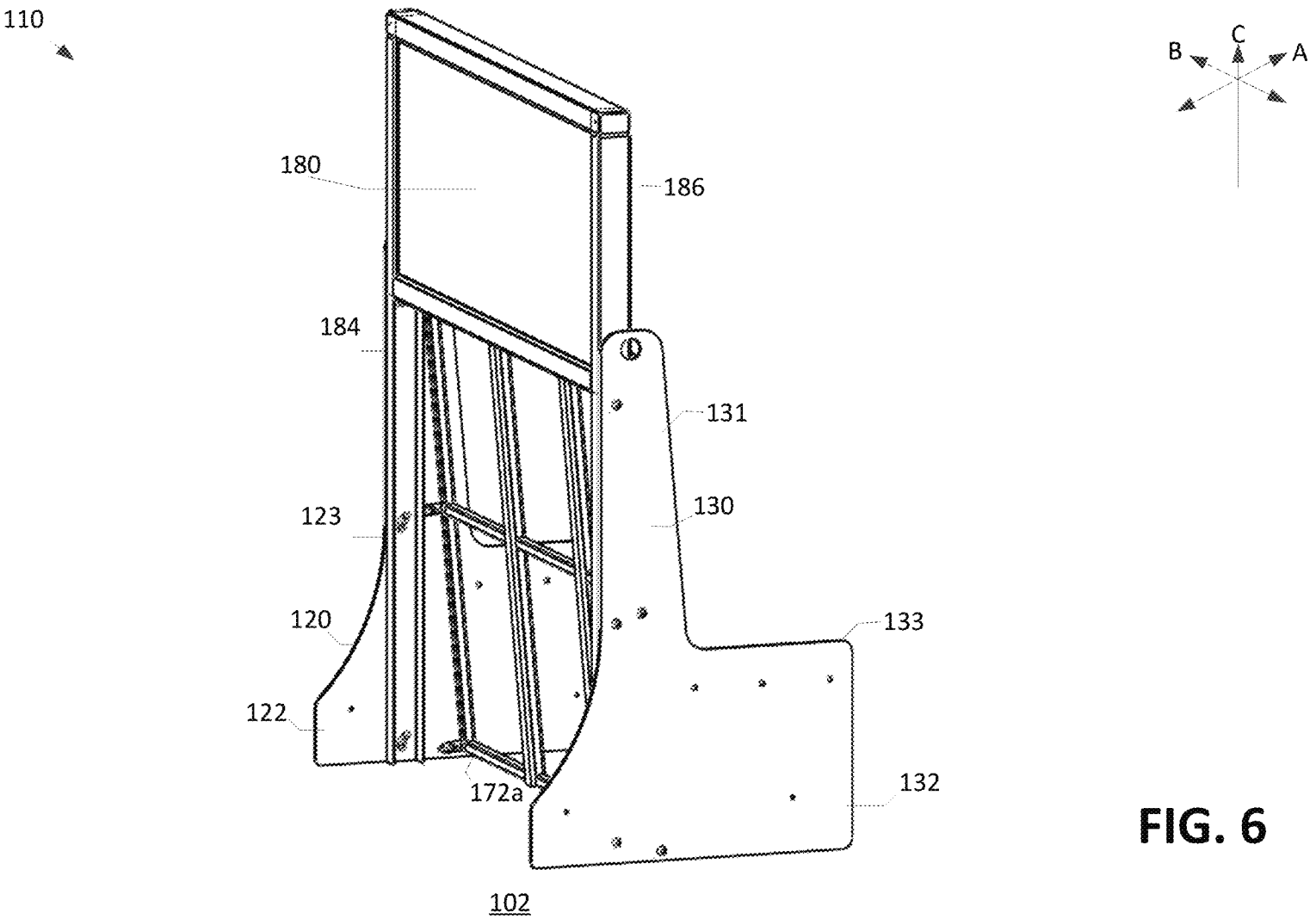
FIG. 6 depicts a rear perspective view of a partially assembled example barrier bench.

FIG. 6 provides a rear perspective view of a partially assembled example bench barrier. For purposes of explanation, backrest panels 150*a-c* are not shown. As illustrated in FIG. 6, side channels 184 and 186 are coupled to side members 120 and 130. At least a portion of upper wall is positioned in side channels so as to limit or prevent horizontal movement of upper wall 180. Side channels 184 and 186, in combination with support member 182 secure upper wall 180 in position relative to the remainder of barrier bench 110.

Figure 7:
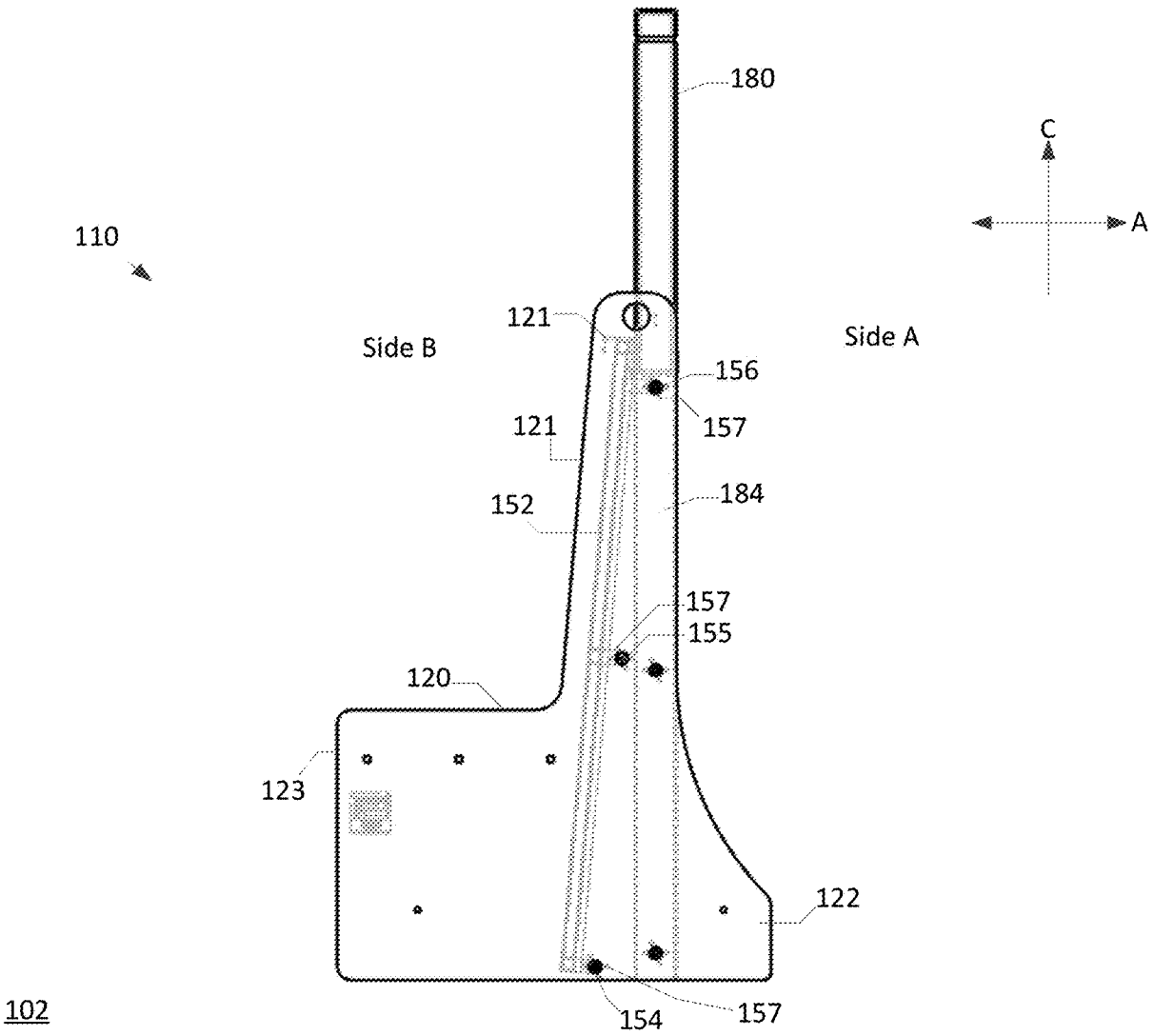
FIG. 7 depicts a side view, partially in transparency, of an example barrier bench.

FIG. 7 provides a side view, partially in transparency, of the partially assembled barrier bench 110 as illustrated in FIG. 6. The positions of side channel 184, support structure 152, and support member 182 are illustrated with dotted and dashed lines. As shown, side channel 184 (and side channel 186 (not shown)) extend substantially perpendicular to the supporting surface. Upper wall 180, which is partially received in side channels 184 and 186 likewise extends substantially perpendicular to the supporting surface. Support structure 152 (described below) upon which backrest panels 150*a-c* are supported is formed at an angle relative to side channels 184, 186 and upper wall 180. Accordingly, backrest panels 150*a-c* are likewise positioned at an angle relative to side channels 184, 186 and upper wall 180. As noted above in connection with FIGS. 4 and 5, the configuration of support member 182 allows for support member 182 to be attached to backrest panels 150*a-c*, while providing support to upper wall 180 which extends at an angle relative to backrest panels 150*a-c*.

Figure 8:
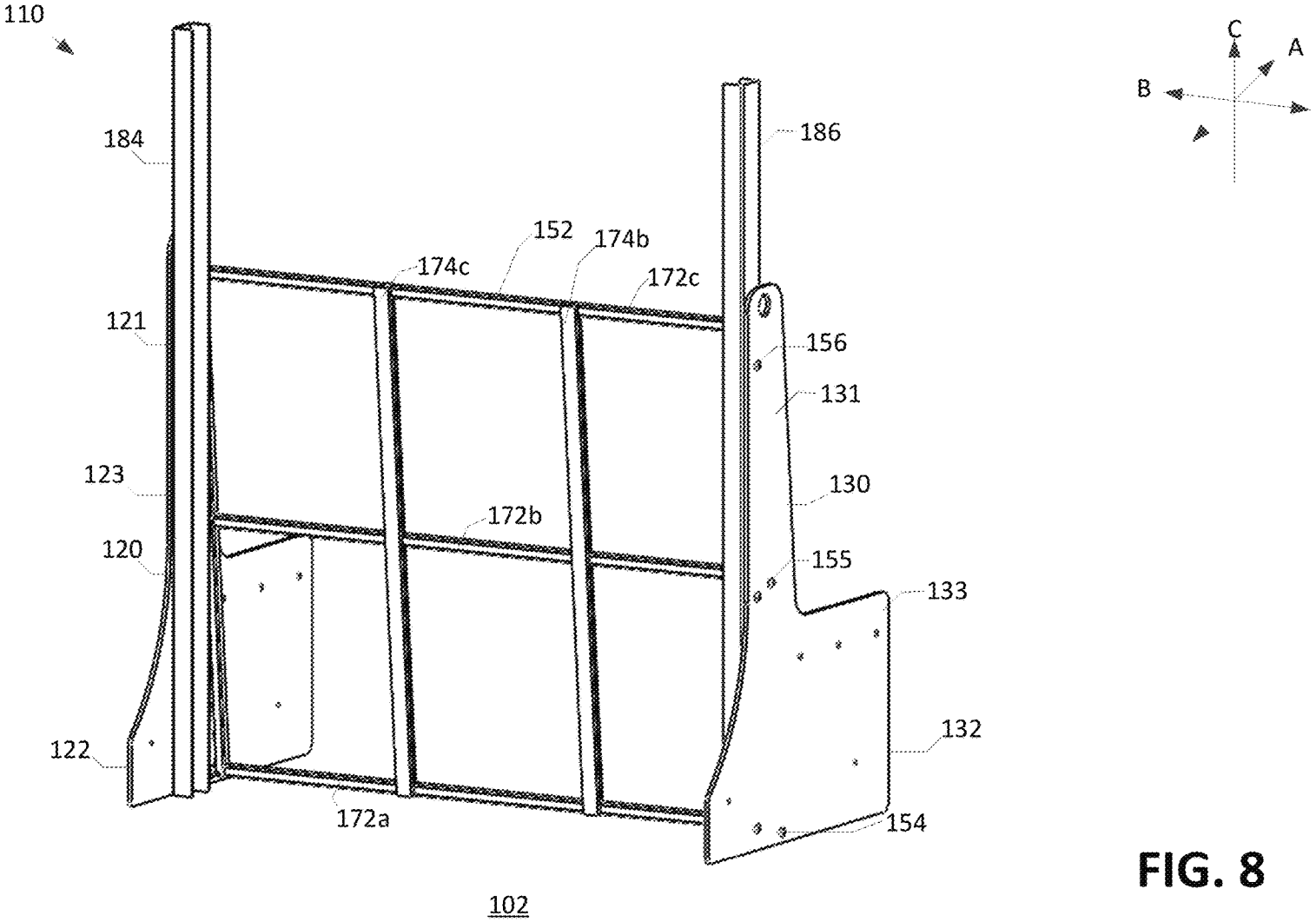
FIG. 8 depicts a rear perspective view of a partially assembled example barrier bench.

FIG. 8 depicts a rear perspective view of a partially assembled example bench barrier. In the illustration of FIG. 8, upper wall 180, backrest panels 150*a-c*, and support member 182 are not shown for purposes of explanation. Side channels 184 and 186 are secured relative to side members 120 and 130 using any suitable means. In an example embodiment, side channels 184 and 186 may be secured to side members 120 and 130 with a fastening means such as, for example, a bolt that extends though apertures formed in side channels 184 and 186 and side members 120 and 130. The bolts may be secured by any suitable means such as, for example, a wing nut or hex nut.

Figure 9:
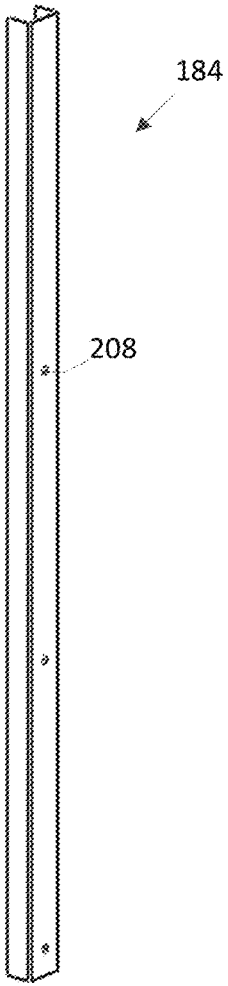
FIG. 9 depicts an isolated perspective view of a side channel.
Figure 10:
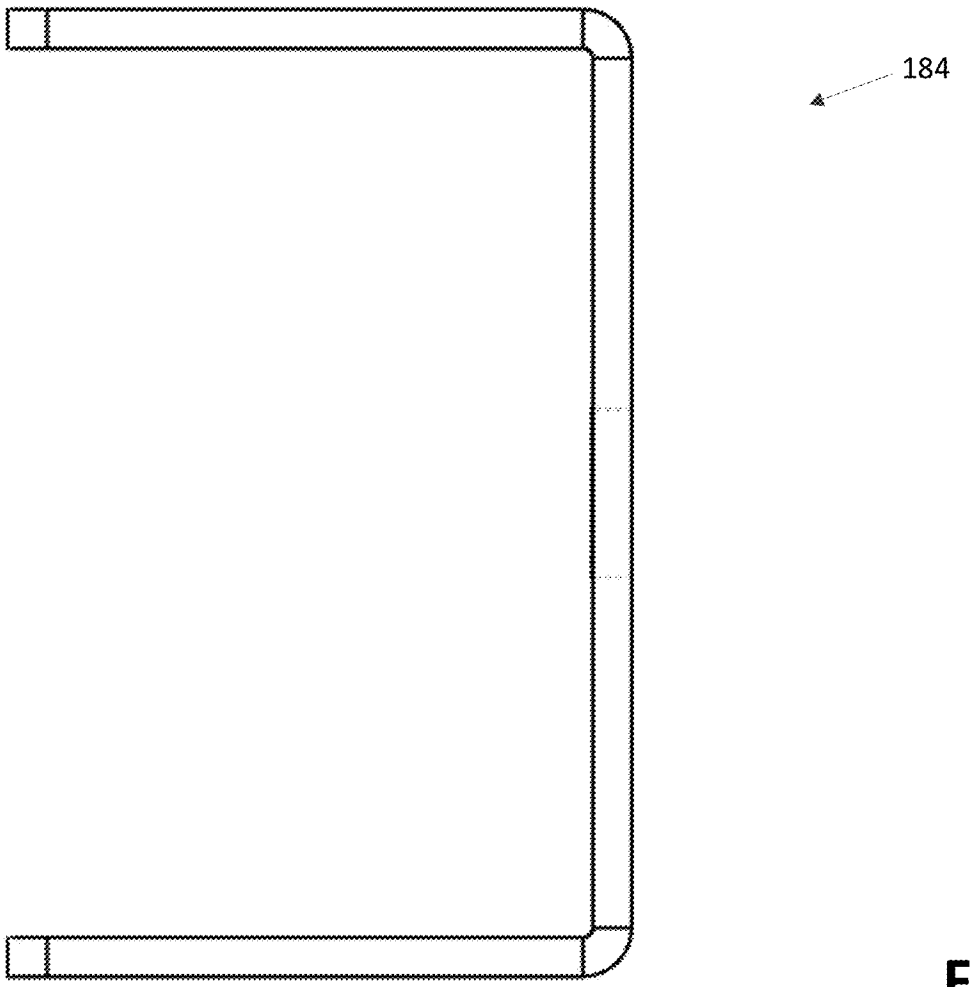
FIG. 10 depicts an isolated sectional view of a side channel.

FIG. 9 provides an isolated perspective view of an example embodiment of side channel 184. As shown, in an example embodiment, side channel 184 may have one or more apertures or holes 208 formed therein which may be aligned with similar apertures in side members 120 and 130 and bolts extended therethrough so as to secure side member 184 relative to the side members. FIG. 10 provides an isolated cross sectional view of side channel 184. As illustrated, side channels comprise two side walls and a base wall extending therebetween to form a channel. The channel is sized so as to receive at least a portion of upper wall 180 therein and limit movement of upper wall 180. While FIGS. 9 and 10 depict side channel 184, it will be appreciated that the provided explanation applies to side member 186 as well.

Figure 11:
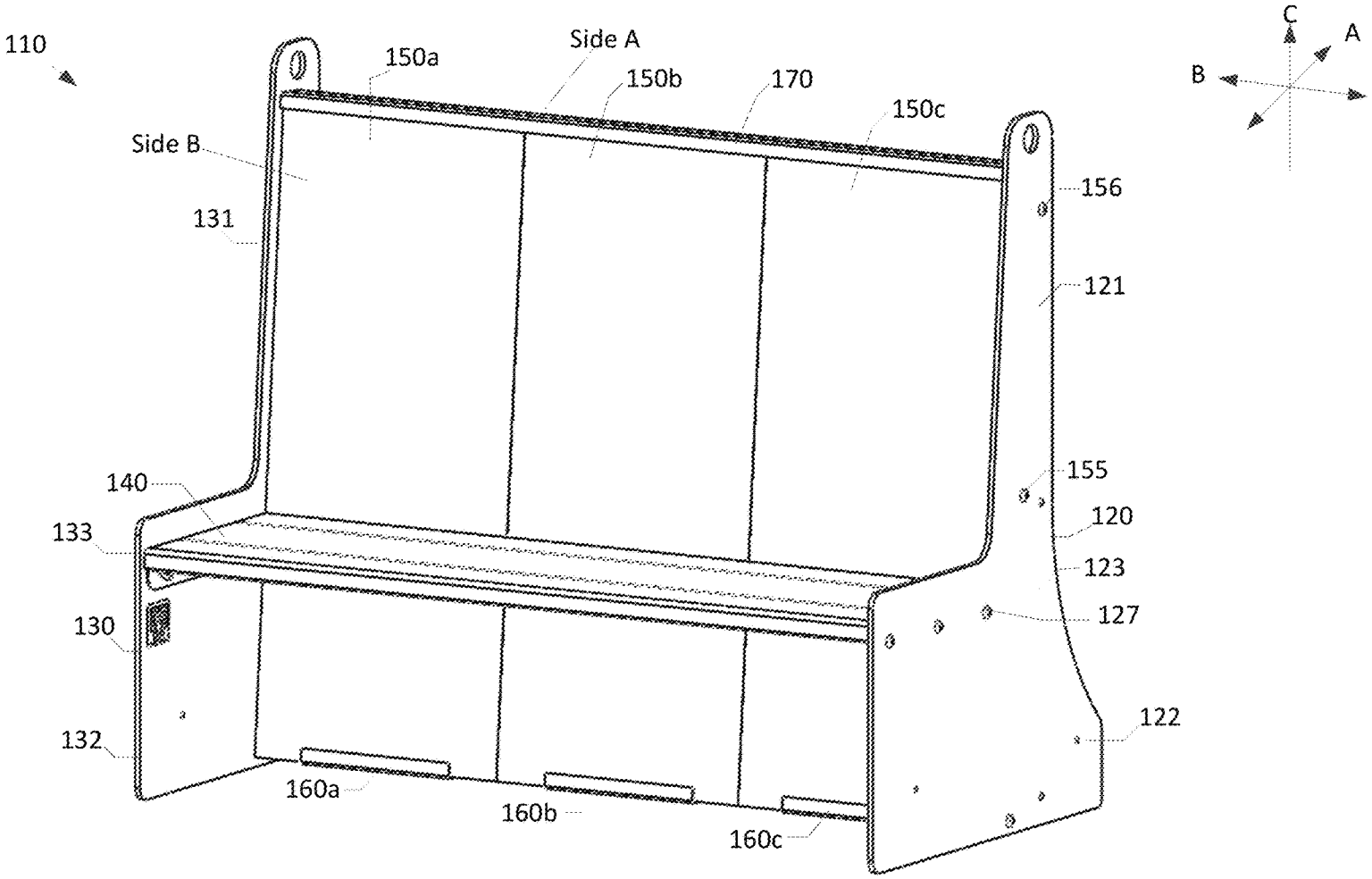
FIG. 11 depicts a front perspective view of a partially assembled example barrier bench.
Figure 12:
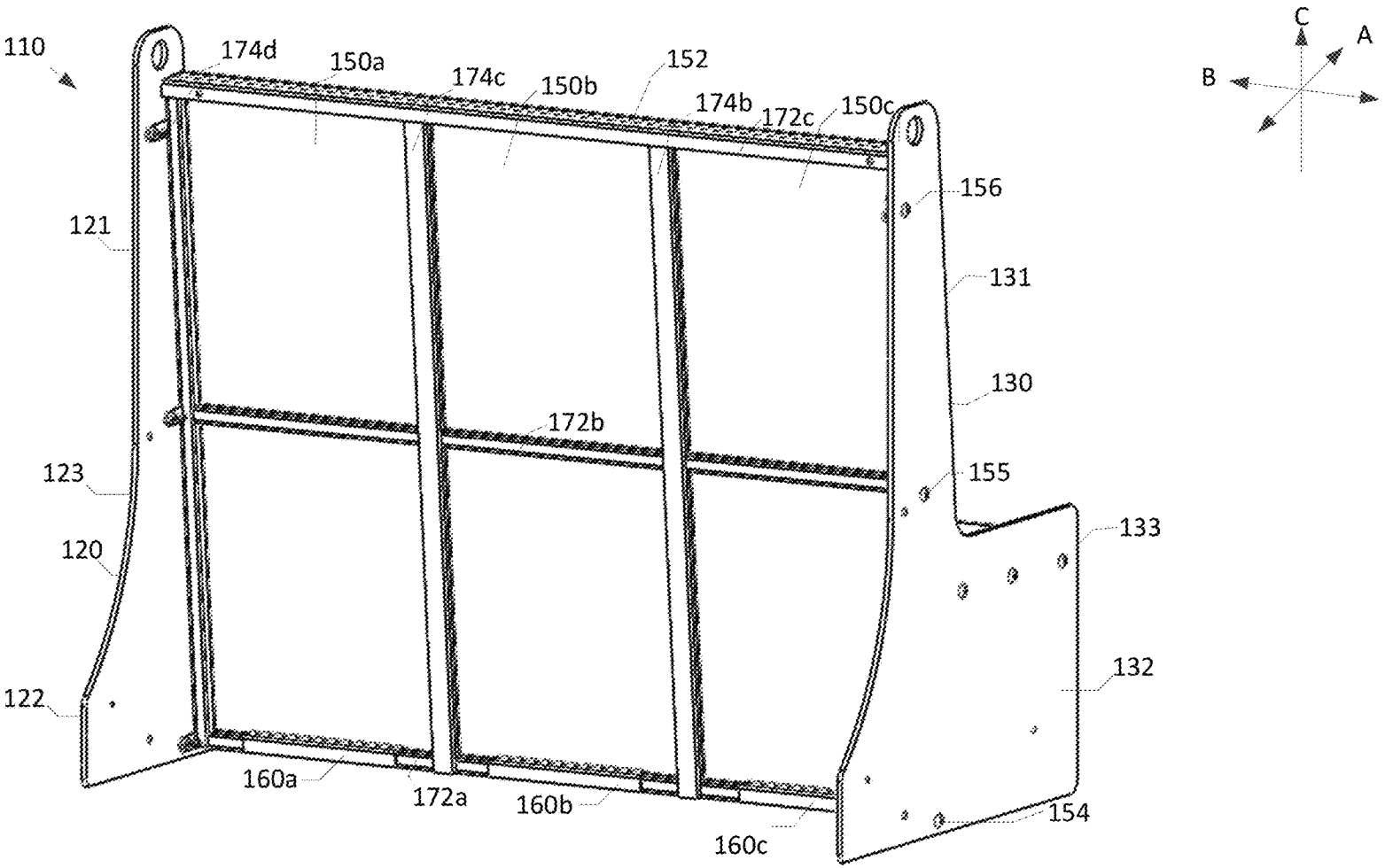
FIG. 12 depicts a rear perspective view of a partially assembled example barrier bench.
Figure 13:
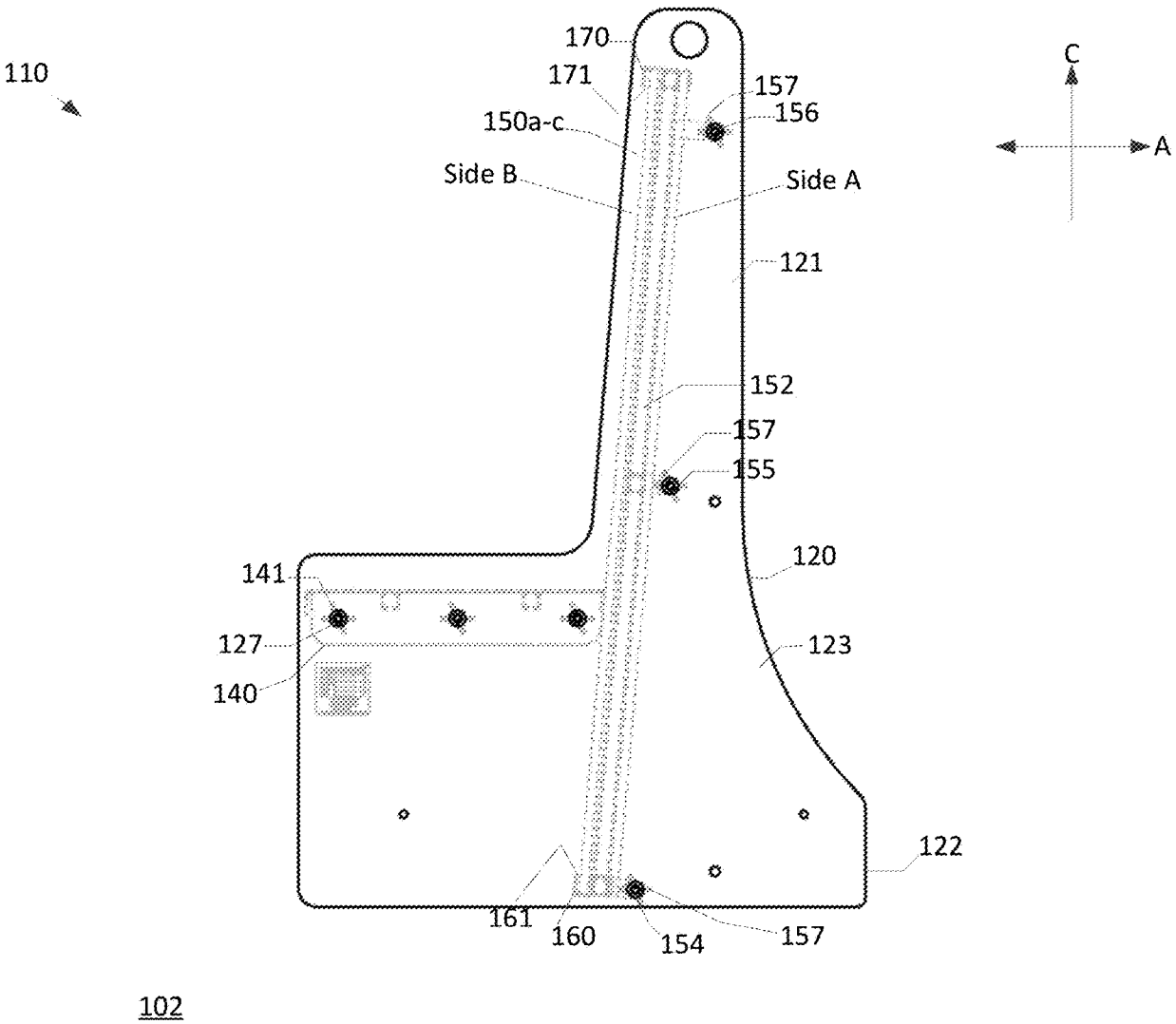
FIG. 13 depicts a side view, partially in transparency, of a partially assembled example barrier bench.

FIG. 11 provides a front perspective view of a partially assembled bench barrier 110. FIG. 12 provides a rear perspective view of the partially assembled bench barrier 110. In the partially assembled embodiment illustrated in FIGS. 11 and 12, side channels 184 and 186, support member 182, and upper wall 180 are not shown. FIG. 13 depicts a side view, partially in transparency, of barrier bench 110 without side channels 184, 186, support member 182, and upper wall 180. The positions of seat member 140, panels 150*a-c*, and support structure 152 are illustrated with dotted and dashed lines. As shown, first side barrier 120 rests upon supporting surface 102 and extends upward in direction C perpendicular to supporting surface 102. Seat member 140 is attached to first side member 120 proximate middle portion 123 of side member 120. Seat member 140 may be attached to side members 120 and 130 using any suitable means. In an example embodiment, bolts 127 may extend through side member 120 and seat member 140 and may be secured using a suitable fastener 141 such as, for example, a wing nut or hex nut. As shown, seat member 140 may abut backrest panels 150*a-c*. Interference between seat member 140 and backrest panels 150*a-c* may assist in securing backrest panels 150*a-c* in place.

Barrier bench 110 may comprise support structure 152 which extends in a substantially upward direction (direction C) from lower portion 122 through middle portion 123 to upper portion 121 of side member 120. In an example embodiment, support structure 152 extends upwardly (direction C) relative to supporting surface 102, but at an angle relative to perpendicular from supporting surface 102. Support structure 152 operates to support backrest panels 150*a-c* so as to maintain backrest panels 150*a-c* in a substantially upright position relative to supporting surface 102. Gravitational forces exerted on backrest panels 150*a-c* cause backrest panels 150*a-c* to abut and be supported by structure 152. In other words, gravitational forces on backrest panels 150*a-c* may cause backrest panels 150*a-c* to lean on support structure 152. Support structure 152 may be rigidly attached to side members 120 and 130 using any suitable means. In an example embodiment, support structure 152 may be affixed relative to side members 120 and 130 using bolts or screws 154, 155, and 156 which extend through openings formed in side members 120 and 130 and support structure 152. Fasteners 157, which may be, for example, nuts that secure bolts 154, 155, and 156 in place.

A portion of each of backrest panels 150*a-c* is received in one of corresponding bottom channel members 160*a-c* which exert an upward force on panels backrest 150*a-c* and prevent the received portion of backrest panels 150*a-c* from moving in direction A substantially parallel to supporting surface 102. More particularly, backrest panels 150*a-c* may be received in one or more panel receiving gaps 161 created by first, second, and base walls of bottom channel members 160*a-c*. Bottom channel members 160*a-c* are secured relative to support structure 152. In an example embodiment, bottom channel members 160*a-c* may have a first portion that is attached to or forms an interference fit with a horizontal member of support structure 152 and a second part for receiving a portion of backrest panels 150*a-c*. In another example embodiment, bottom channels 160-*c* may be attached to side members 120 and 130.

As shown in FIG. 13, upper channel 170 is positioned along a distal end of support structure 152 opposite a distal end of support structure 152 to which bottom channel members 160*a-c* are affixed. In an example embodiment, upper channel 170 is rigidly attached relative to support structure 152. Upper channel 170 receives panels 150*a-c* in a gap 171 formed from two spaced side walls and a bottom. As shown, the gap 171 is positioned opposite the panel receiving gaps 161 created by channel members 160*a-c*. Backrest panels 150*a-c* are positioned in both gaps 171 and 161. Accordingly, upper channel 170 assists in securing backrest panels 150*a-c* in place relative to the remainder of barrier bench 110. More particularly, upper channel 170 may block or prevent backrest panels 150*a-c* from moving in direction A substantially parallel to supporting surface 102. Likewise, upper channel 170 may block or prevent backrest panels 150*a-c* from moving in a direction C upward away from base surface 102 and bottom channel members 160*a-c*.

Accordingly, backrest panels 150*a-c* may be supported by and maintained in place by cooperation with bottom channel components 160*a-c*, support structure 152, seat member 140, and upper channel 170. Backrest panels 150*a-c* extend in a substantially upward direction (direction C) relative to supporting surface 102. With respect to direction A, backrest panels 150*a-c* define a first side (side A) and a second side (side B) opposite the first side. Backrest panels 150*a-c* are configured to prevent a projectile that strikes a first side (e.g., side A) from penetrating and proceeding through the second side (e.g., side B).

Figure 14:
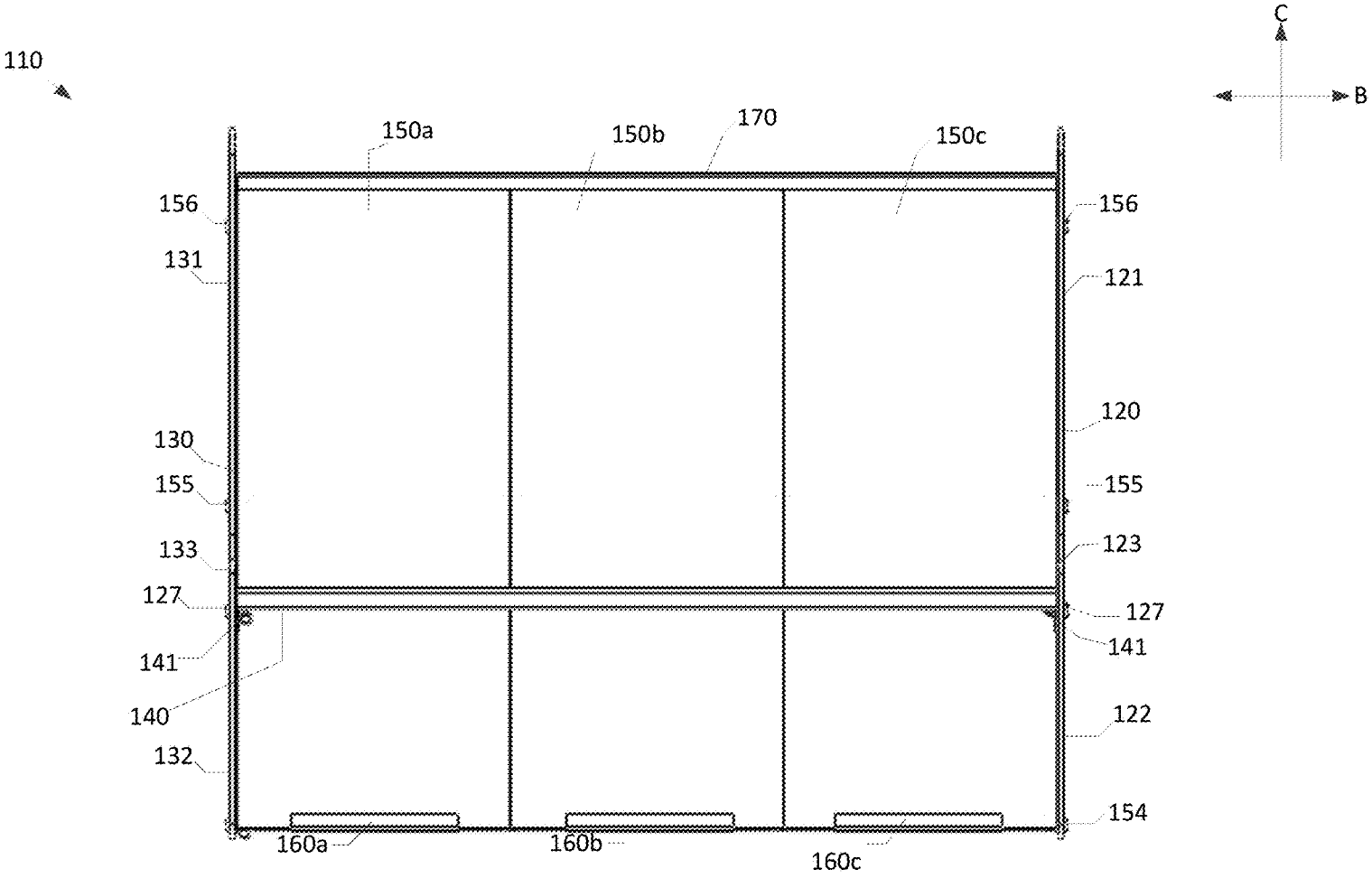
FIG. 14 depicts a front view of a partially assembled example barrier bench.

FIG. 14 depicts a front view of a partially assembled example barrier bench 110 as shown in FIGS. 12-13. As shown in FIG. 14, seat member 140 extends between side members 120 and 130 and is secured thereto with bolts 127 and fasteners 141. Bottom channel members 160*a-c* and upper channel 170 secure backrest panels 150*a-c* relative to the supporting surface 102.

It will be appreciated from FIGS. 1-23 that barrier bench 110 is configured such that the barrier may be assembled relatively easily with relatively few simple fasteners. Further, in an example embodiment, the fasteners may be arranged to be made along direction B through side members 120 and 130. In such an embodiment, backrest panels 150*a-c* may be devoid of fasteners that extend into and/or through panels, which could have the impact of compromising the strength and/or defensive capabilities of backrest panels 150*a-c* and barrier bench 110 as a whole. In an example embodiment, the assembled barrier bench 110 provides a unified and uncompromised barrier to ballistics and explosions.

Figure 15:
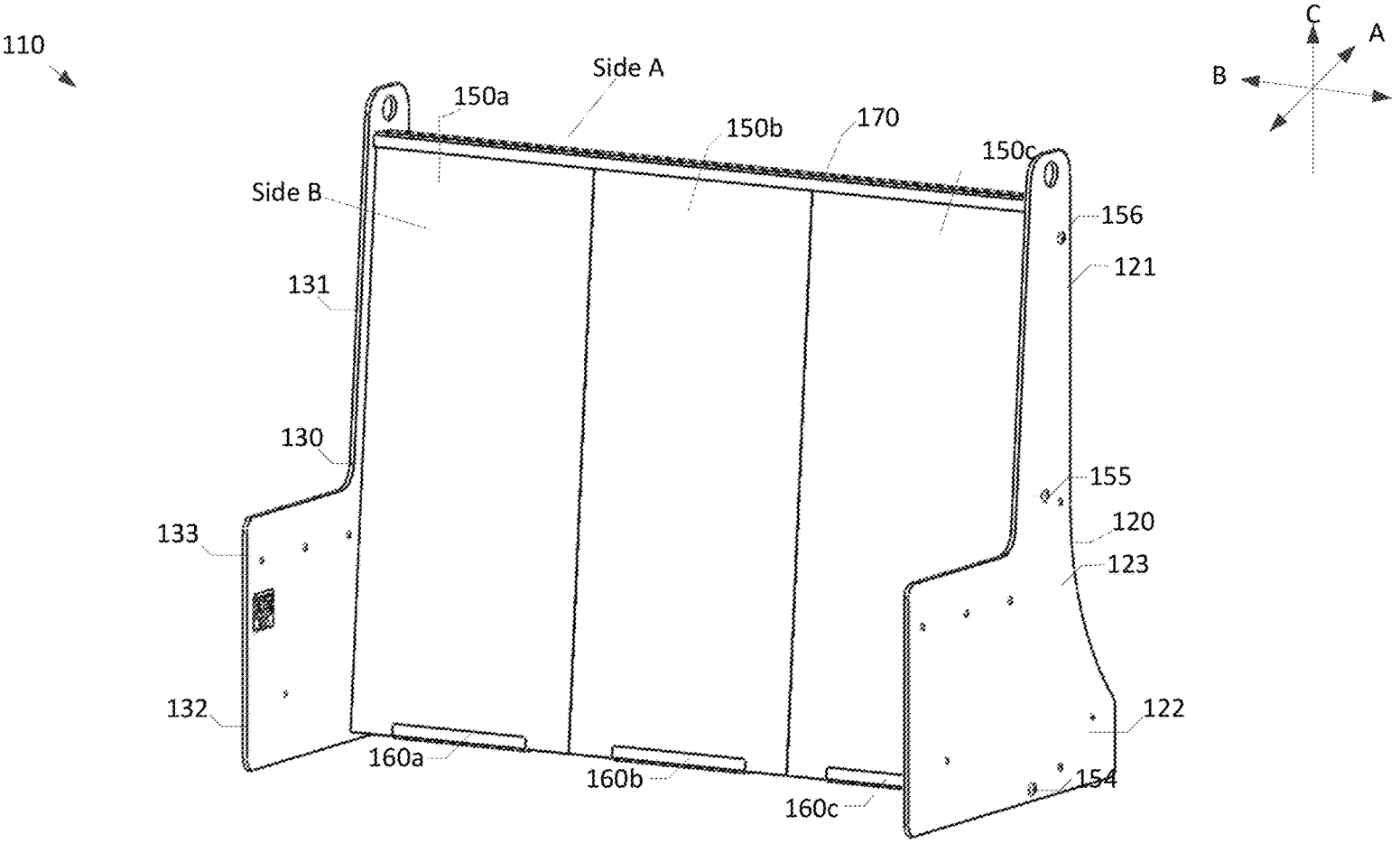
FIG. 15 depicts a front perspective view of a partially assembled example barrier bench.

FIG. 15 depicts a perspective view of a partially assembled barrier bench 110. In FIG. 15, seat member 140, side channels 184, 186, support member 182, and upper wall 180 are not illustrated for purposes of explanation. As shown, in an example embodiment, bottom channel members 160*a-c* are attached to support structure 152. Bottom channel members 160*a-c* receive a portion of backrest panels 150*a-c* and maintain the lower portions of backrest panels 150*a-c* in place in direction A. Similarly, upper channel 170 receives a portion of one or more of backrest panels 150*a-c* and assist in maintaining backrest panels 150*a-c* in place relative to direction A. Backrest panels 150*a-c* are positioned side-by-side so as to eliminate any gap between panels and thereby create a unified wall or protective shield.

Figure 16:
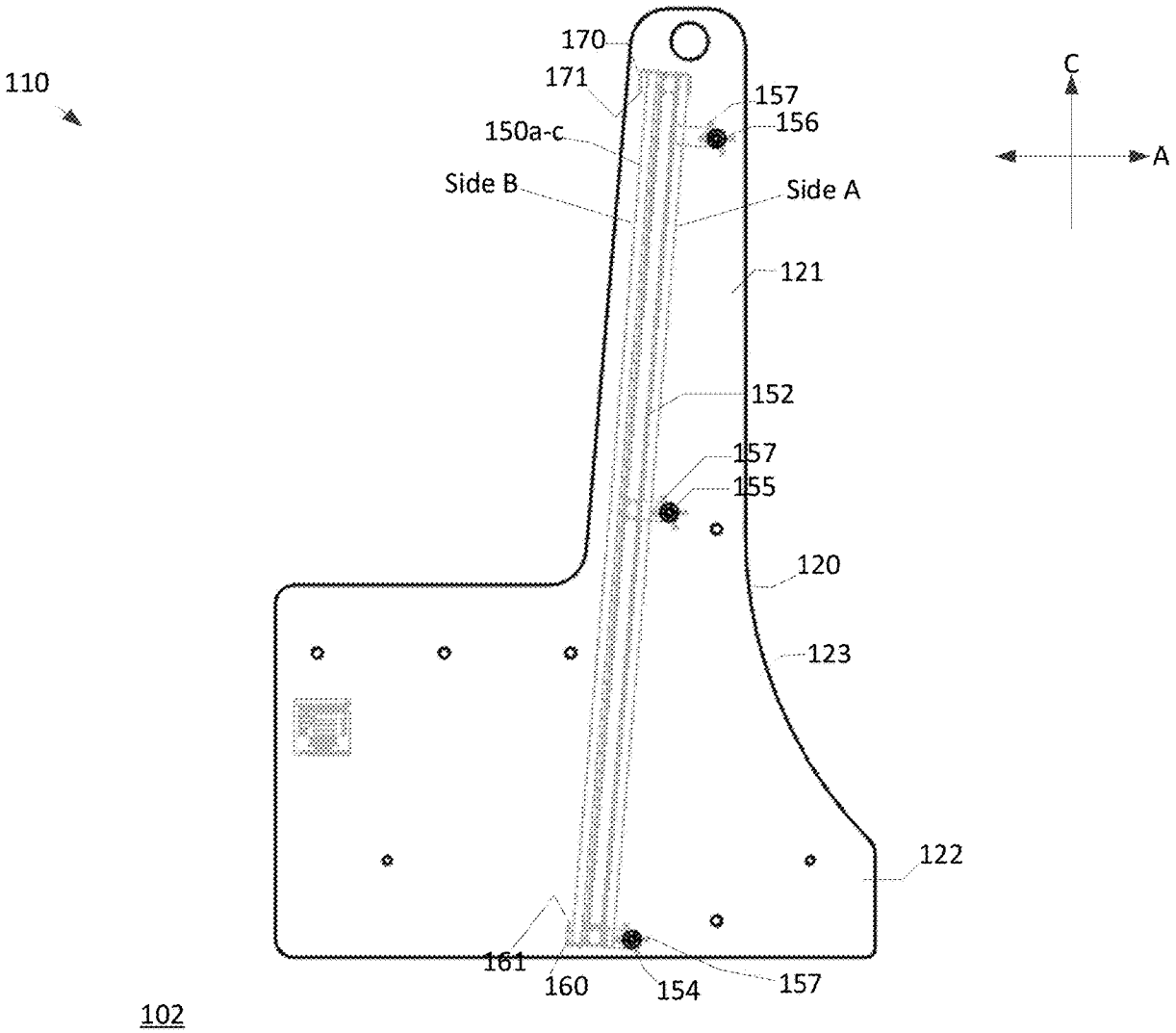
FIG. 16 depicts a side view, partially in transparency, of a partially assembled example barrier bench.

FIG. 16 depicts a side view of the partially assembled barrier bench 110 depicted in FIG. 15. Barrier bench 110 is depicted in partial transparency with the location of component portions depicted in dotted and dashed lines. As shown, support structure 152 is attached to side members 120, 130 using bolts 154, 155, and 156 and fasteners 157. Bolts 154, 155, and 156 are staggered across the length of side member 120 so that support structure 152 is positioned at an angle relative to a perpendicular to supporting surface 102. Gravitational forces exerted on backrest panels 150*a-c* cause backrest panels 150*a-c* to abut and be supported by structure 152. In other words, gravitational forces on backrest panels 150*a-c* cause panels 150*a-c* to lean on support structure 152. Bottom channel members 160*a-c*, which are secured to support structure 152, support panels 150*a-c* in position vertically. Additionally, bottom channel members 160*a-c* secure backrest panels 150*a-c* in position horizontally with respect to direction A. Upper channel 170 is likewise secured relative to support structure 152. It too secures backrest panels 150*a-c* in position horizontally.

Figure 17:
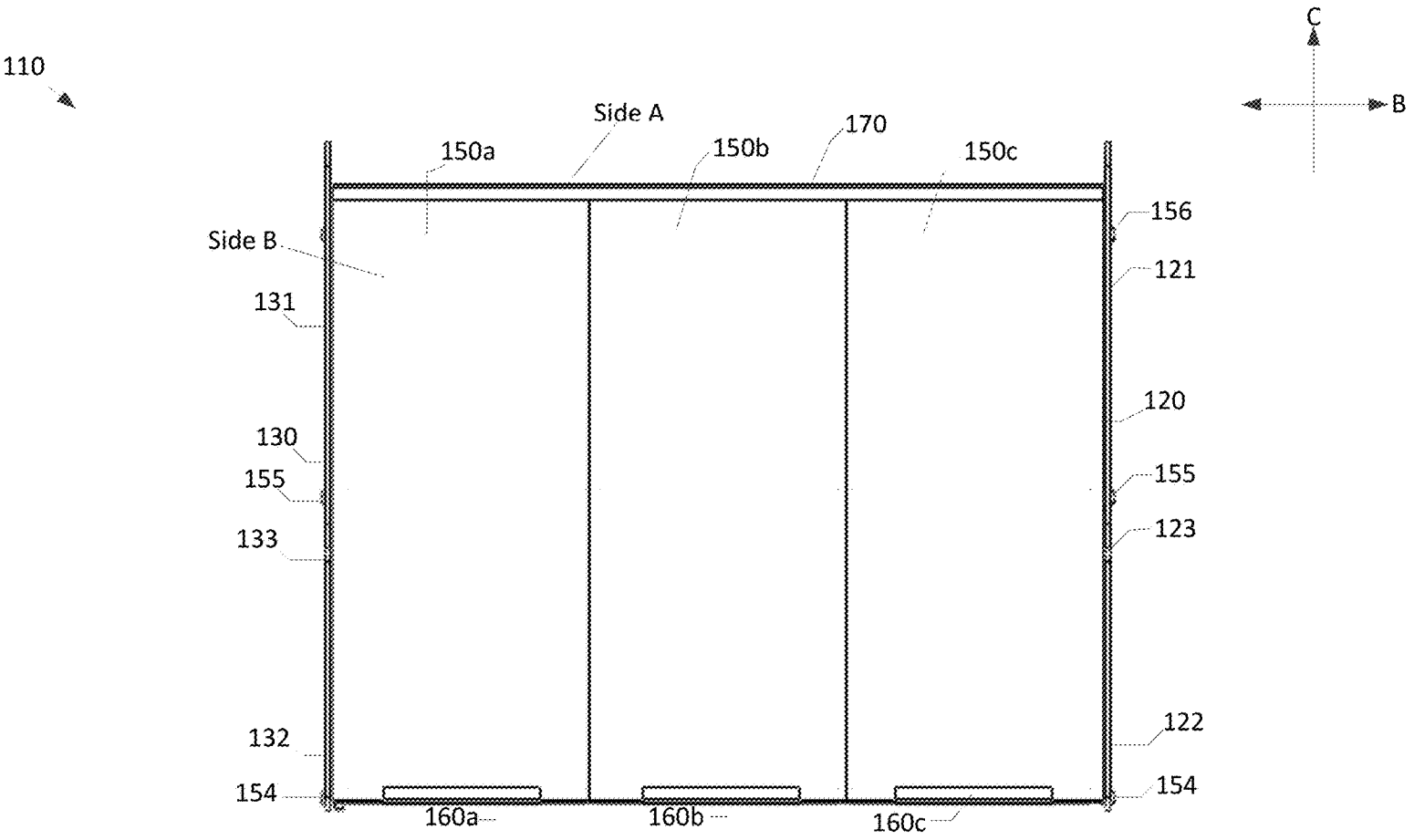
FIG. 17 depicts a front view of a partially assembled example barrier bench.

FIG. 17 depicts a front view of the example partially assembled barrier bench 110 as depicted in FIGS. 15 and 16. As shown, backrest panels 150*a-c* are positioned edge-to-edge and tightly fitted against side walls 120 and 130. Bottom channel members 160*a-c* support and position backrest panels 150*a-c* vertically. Additionally, bottom channel members 160*a-c* secure backrest panels 150*a-c* in position horizontally with respect to direction A. Upper channel 170 likewise secures panels 150*a-c* in position horizontally.

Figure 18:
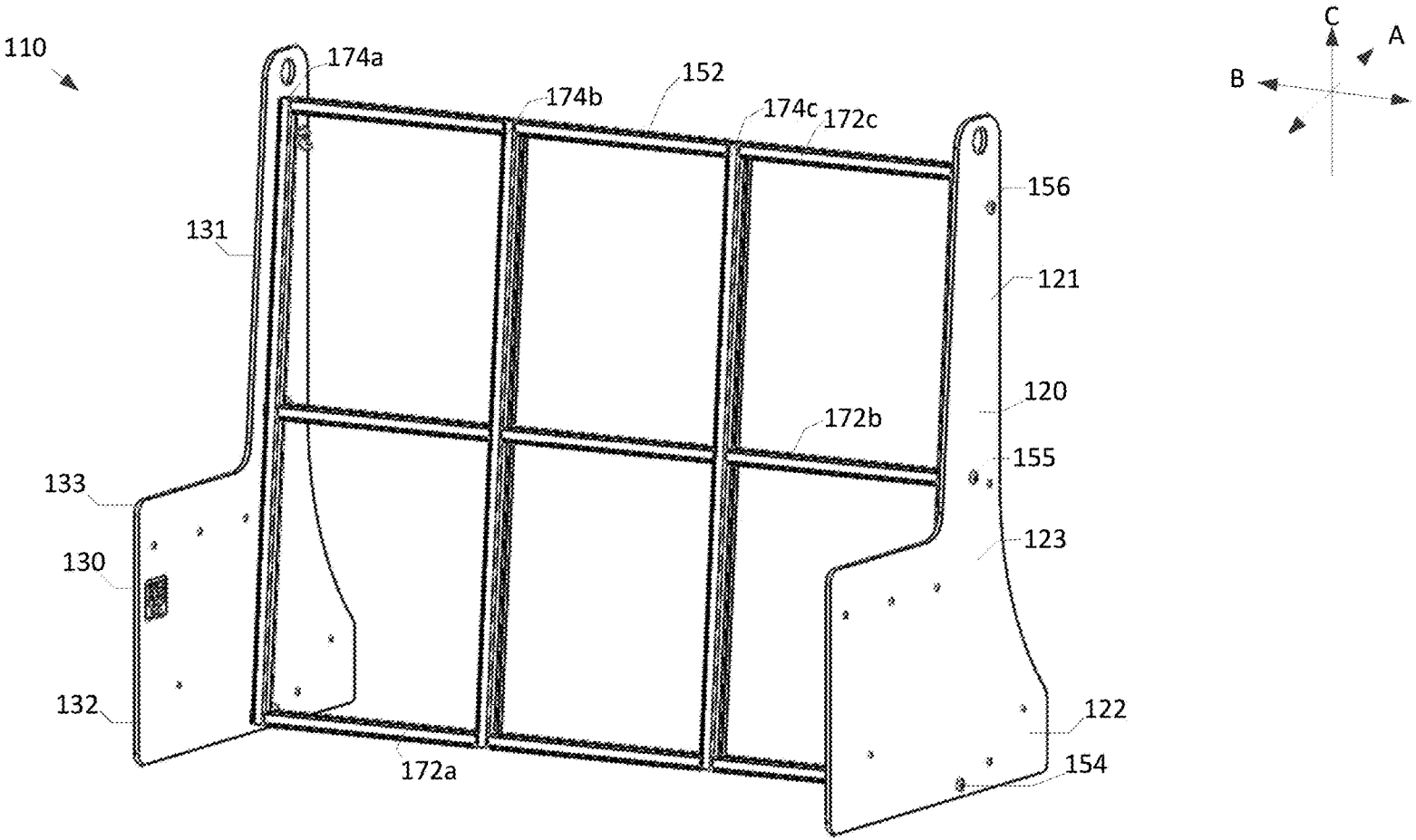
FIG. 18 depicts a front perspective view of a partially assembled example barrier bench.
Figure 19:
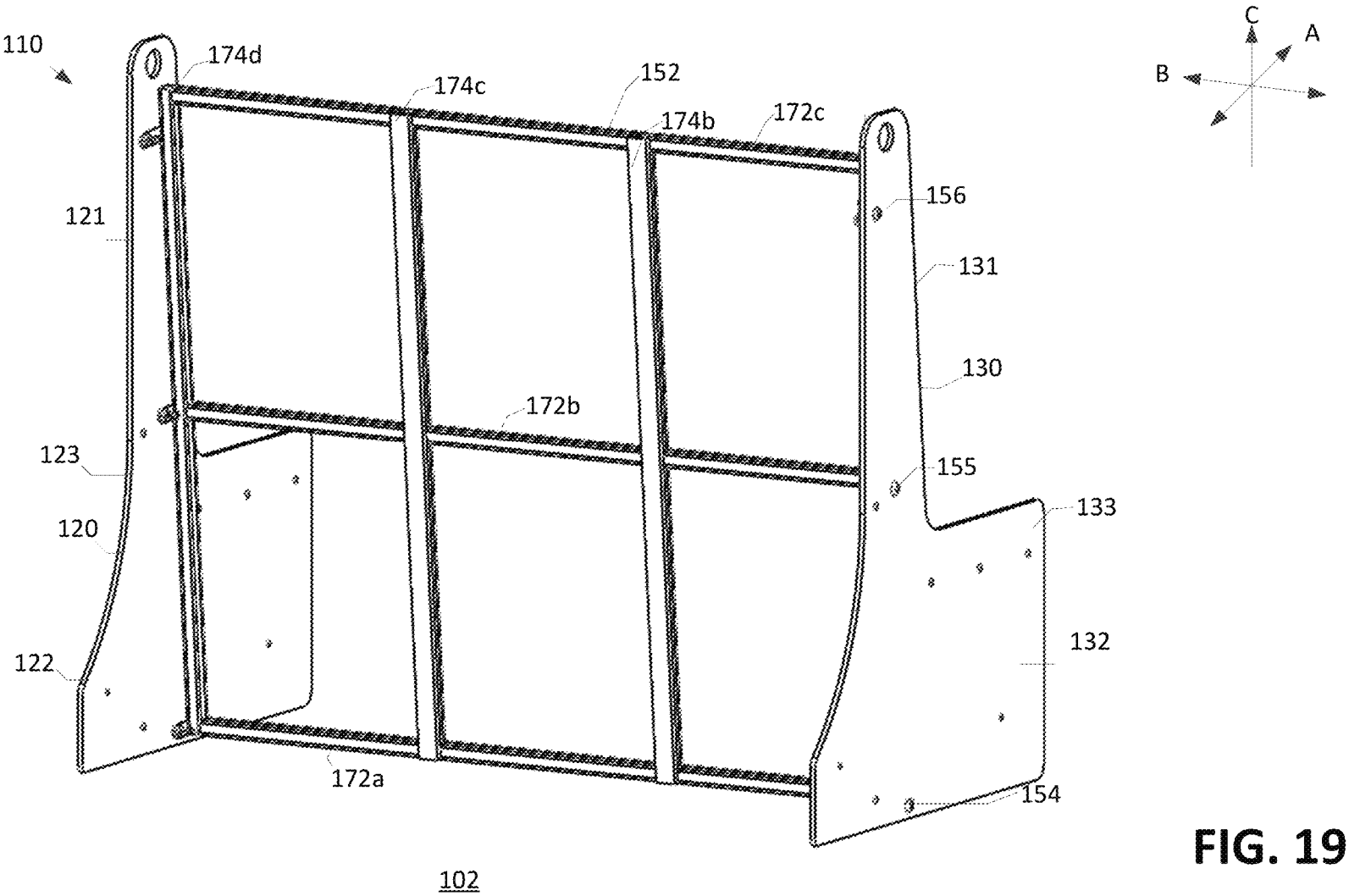
FIG. 19 depicts a rear perspective view of a partially assembled example barrier bench.

FIG. 18 depicts a front perspective view of a partially assembled example barrier bench 110. FIG. 19 depicts a rear perspective view of the partially assembled example barrier bench 110. In FIGS. 18 and 19, seat member 140, side channels 184, 186, support member 182, upper wall 180, and backrest panels 150*a-c* are not illustrated for purposes of explanation. As illustrated, in an example embodiment, support structure 152 extends between first and second side members 120 and 130 and is attached thereto using bolts 154, 155, and 156 along with fasteners 157. In an example embodiment, support structure may comprise a series of horizontal members or bars 172*a-c* and vertical members or bars 174*a-d*. In an example embodiment, horizontal bar 172*a* may be adapted to receive or be rigidly attached with channel members 160*a-c*. In an example embodiment, horizontal bar 172*c* may be adapted to receive or be rigidly attached with upper channel 170. In an example embodiment, vertical bars 174*a-d* are positioned so as to correspond to and overlap edges of panels 150*a-c*. Vertical bar 174*a* may be adapted to overlap the edge of panel 150*a* at the junction between panel 150*a* and side member 130. Vertical bar 174*b* may be configured to overlap the edges of panels 150*b* and 150*c* at the location where those two panels abut each other. Similarly, vertical bar 174*c* may be configured to overlap with the edges of panels 150*c* and 150*d* at the location where those two panels abut each other. Vertical bar 174*d* may be positioned to overlap with the edge of panel 150*c* at the junction between panel 150*c* and side member 120. Accordingly, vertical bars 174*a-d* cover and overlap panels 150*a-d* where panels 150*a-d* abut or interface with each other. As a consequence, vertical bars 174*a-d* provide additional protection from ballistics traveling in direction A. Vertical bars 174*a-d* and horizontal bars 172 serve as armor strips and may made from any suitable material including, for example, ballistic and blast resistant metal, masonry, and/or carbon fiber. In the example embodiment, vertical support members 174*a-d* are distributed across the length (in Direction B) of support structure 152. Horizontal support members 172*a-c* are distributed across the vertical height (in Direction C) of support structure 152.

Figure 20:
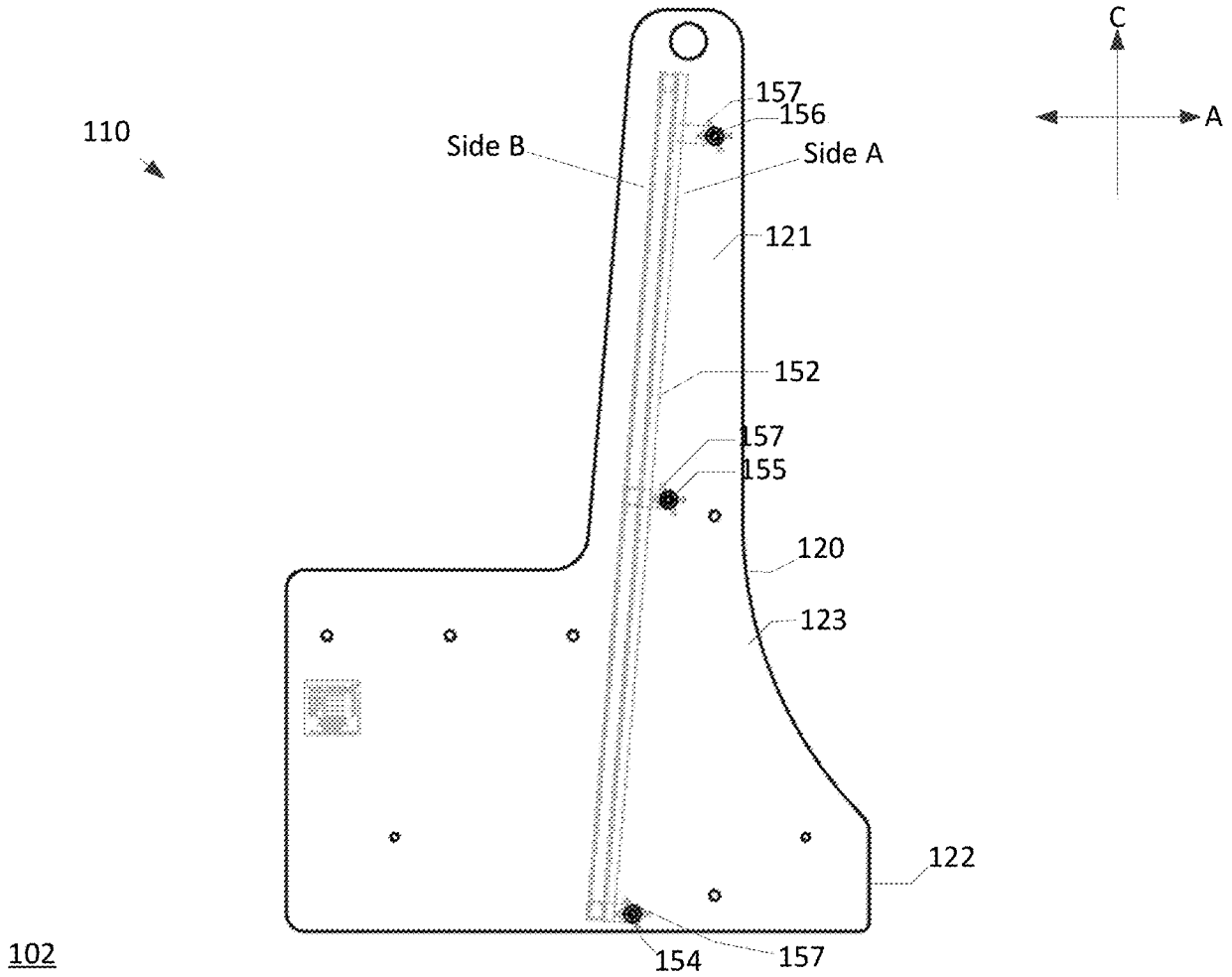
FIG. 20 depicts a side view, partially in transparency, of a partially assembled example barrier bench.

FIG. 20 depicts a side view of the partially assembled barrier bench 110 depicted in FIGS. 18 and 19. For purpose of explanation, barrier bench 110 is depicted in partial transparency with the location of component portions depicted in dotted and dashed lines. As shown, support structure 152 is attached to side members 120, 130 using bolts 154, 155, and 156 and fasteners 157. Bolts 154, 155, and 156 are staggered across the length of side member 120 (across direction A) so that support structure 152 is positioned at an angle relative to a perpendicular to supporting surface 102. A slight angle relative to perpendicular facilitates panels 150*a-c* taking a position abutting support structure 152 by operation of the effect of gravity on panels 150*a-c*.

Figure 21A:
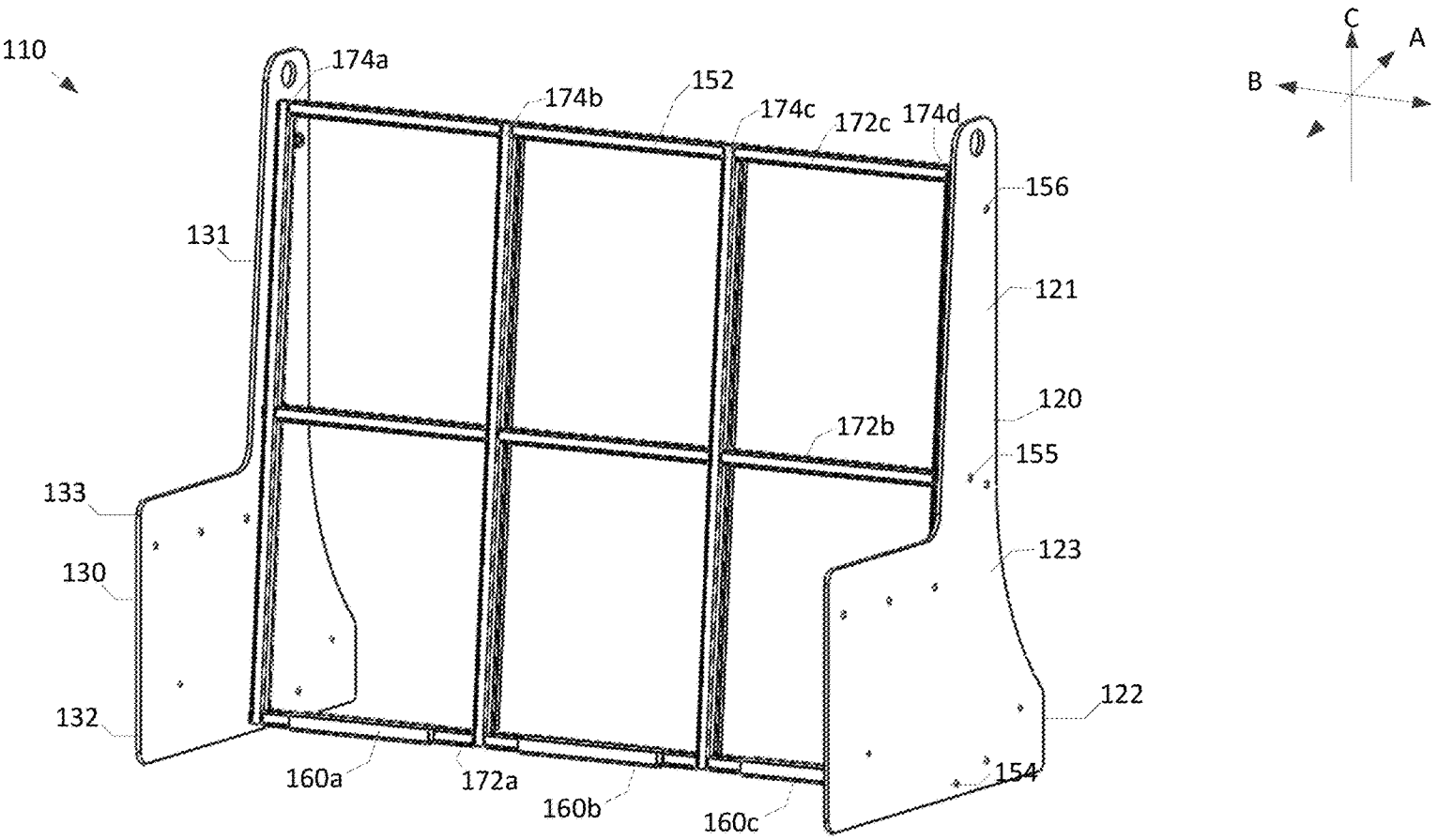
FIG. 21A depicts a perspective view of a partially assembled example barrier bench.
Figure 21B:
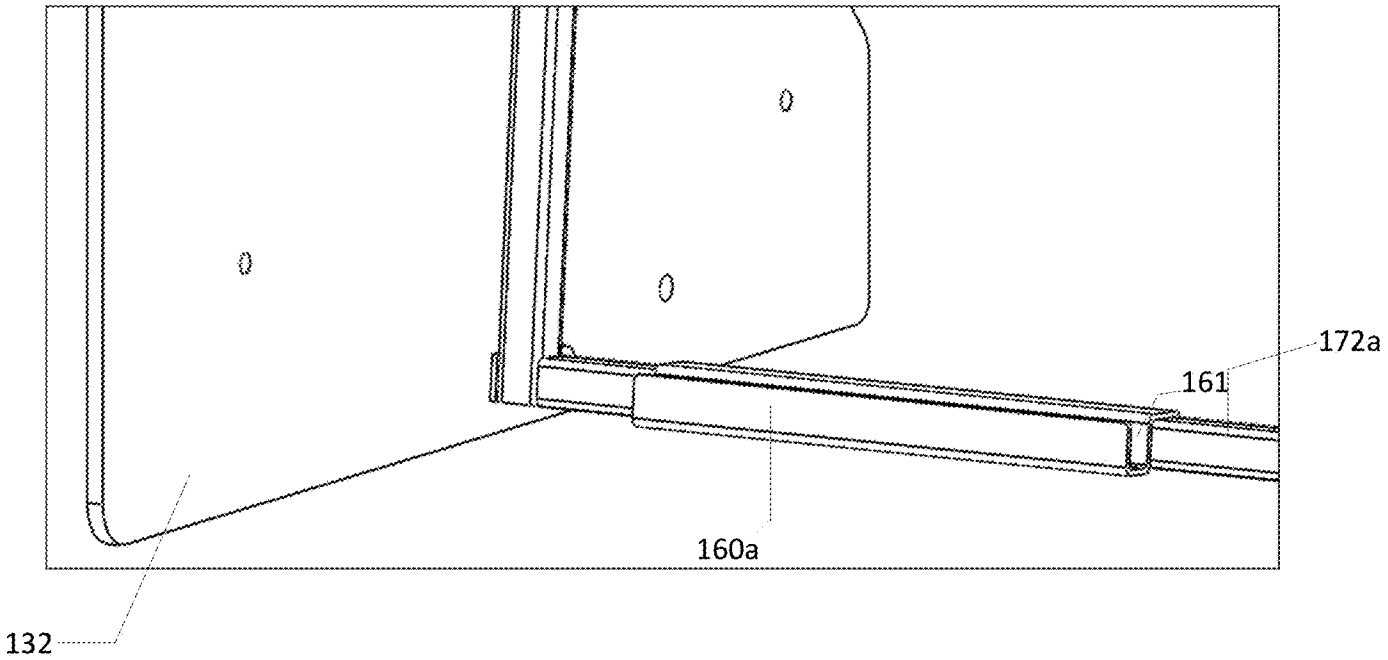
FIG. 21B depicts an isolated view of a portion of a partially assembled exampled barrier bench.

FIG. 21A depicts a front perspective view of a partially assembled bench barrier 110. FIG. 21B depicts an isolated view of bottom channel member 160*a* interfacing with horizontal support member 172*a*. In FIGS. 21A, B, seat member 140, side channels 184, 186, support member 182, upper wall 180, and backrest panels 150*a-c* are not illustrated for purposes of explanation. As shown, bottom channel members 160*a-c* are coupled to horizontal support members 172*a* of support structure 152 and are adapted to receive backrest panels 150*a-c* (not shown) therein. In an example embodiment, lower bottoms of bottom channel members 160*a-c* are positioned at or proximate a height equivalent to that of lower portions 122, 132 of side members 120, 130.

Figure 22:
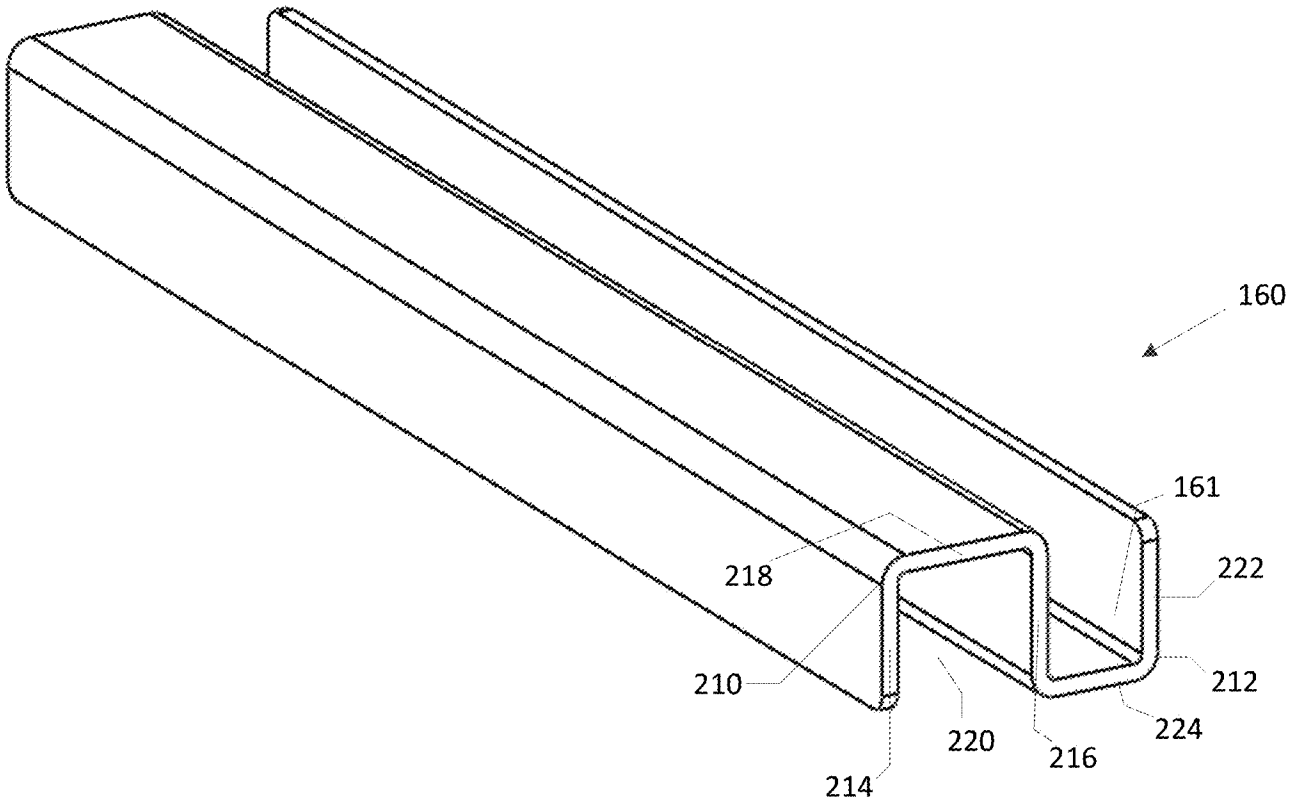
FIG. 22 depicts an isolated perspective view of an example bottom channel member.
Figure 23:
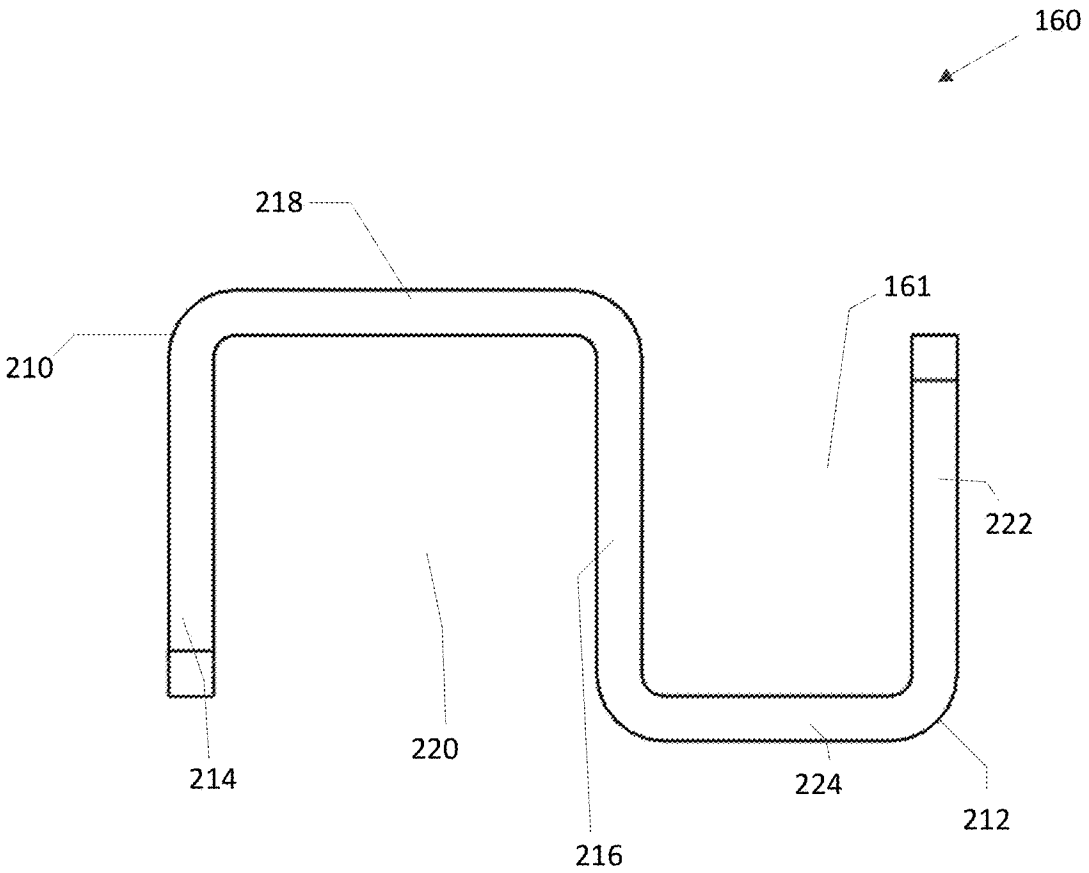
FIG. 23 depicts a sectional view of an example bottom channel member.

FIG. 22 provides an isolated perspective view of an example bottom channel member 160. FIG. 23 provides a side view of an example bottom channel member 160. In an example embodiment, channel member 160 may comprise a mounting bracket 210 and a panel receiving gap 161. Mounting bracket 210 is formed so as to be removably attachable to horizontal support member 172. In an example embodiment, mounting bracket comprises a first wall 214, a second wall 216, and a bottom wall 218 extending therebetween so as to form a channel 220. Channel 220 may be positioned over horizontal support member 170*a*. Panel receiving gap 161 is formed from wall 216, wall 222, and bottom wall 224 extending therebetween to form channel 212. Panel receiving gap 161 is sized so as to receive at portion of a backrest panel 150*a* therein.

Accordingly, Applicant has disclosed a bench that is constructed to serve as a barrier from ballistics and explosions. The bench serves the traditional role of providing a seating area while also providing protection from ballistics and explosions originating from an opposite side of the bench. The bench may comprise one or more panels or plates that are adapted to repel ballistics and blasts and which are positioned in a substantially upward direction relative to the supporting surface. A series of interconnected members that together form a frame serves to position the one or more panels in a relatively upright position so as to form a barrier against ballistics and explosion blasts.

Conditional language used herein, such as, among others, "can," "could," "might," "may," "e.g." and the like, unless specifically stated otherwise, or otherwise understood within the context as used, is generally intended to convey that certain embodiments include, while other embodiments do not include, certain features, elements, and/or steps. Thus, such conditional language is not generally intended to imply that features, elements and/or steps are in any way required for one or more embodiments or that one or more embodiments necessarily include logic for deciding, with or without author input or prompting, whether these features, elements and/or steps are included or are to be performed in any particular embodiment. The terms "comprising," "including," "having" and the like are synonymous and are used inclusively, in an open-ended fashion, and do not exclude additional elements, features, acts, operations and so forth. Also, the term "or" is used in its inclusive sense (and not in its exclusive sense) so that when used, for example, to connect a list of elements, the term "or" means one, some or all of the elements in the list.

The foregoing description is provided for the purpose of explanation and is not to be construed as limiting the potential embodiments. While the embodiments have been described with reference to preferred embodiments or preferred methods, it is understood that the words which have been used herein are words of description and illustration, rather than words of limitation. Furthermore, although the invention has been described herein with reference to particular structure, methods, and embodiments, the potential embodiments are not intended to be limited to the particulars disclosed herein, as the potential embodiments extend to all structures, methods and uses that are within the scope of the appended claims. Further, to the degree that advantages have been described that flow from the structure and methods; the potential embodiments are not limited to structure and methods that encompass any or all of these advantages. Those skilled in the relevant art, having the benefit of the teachings of this specification, may effect numerous modifications to the potential embodiments as described herein, and changes can be made without departing from the scope and spirit of the potential embodiments as defined by the appended claims. Furthermore, any features of one described embodiment can be applicable to the other embodiments described herein.

What is claimed is:

1. A barrier comprising:

a bench comprising:

a backrest panel extending in a substantially upward direction relative to a supporting surface on which the bench is positioned, the backrest panel having an upper edge remote from the supporting surface;

a first side member coupled to the backrest panel and positioned at an angle relative to the backrest panel, the first side member extending substantially perpendicular to the supporting surface and configured to support the bench upon the supporting surface;

a second side member spaced from the first side member and positioned at an angle relative to the backrest panel, the second side member extending substantially perpendicular to the supporting surface and configured to support the bench upon the supporting surface; and a seat member coupled to the first side member and the second side member and forming a surface substantially parallel with respect to the supporting surface;

a support member secured relative to the backrest panel and positioned below the upper edge of the backrest panel;

a first side channel secured to the first side member and extending substantially upward away from the supporting surface and beyond the upper edge of the backrest panel, the first side channel forming a first channel; and an upper wall having a lower edge, wherein at least a portion of the upper wall is received in the first side channel, at least a portion of the upper wall abuts and is supported by the support member, and the lower edge of the upper wall is positioned below the upper edge of the backrest panel so that a portion of the upper wall overlaps the backrest panel.

2. The barrier of claim 1, wherein the backrest panel defines a first side and a second side, wherein the seat member is positioned on the first side, and wherein the first side channel and at least a portion of the upper wall are positioned on the second side.

3. The barrier of claim 2, further comprising:

a second side channel secured to the second side member and extending substantially upward away from the supporting surface and beyond the upper edge of the backrest panel, the second side channel forming a second channel, wherein at least a portion of the upper wall is received in the second side channel.

4. The barrier of claim 3, wherein a first end of the first side channel is adjacent to a lower portion of the first side member and abuts the supporting surface, the first side channel extending along the first side member and beyond an upper portion of the first side member, and wherein a first end of the second side channel is adjacent to a lower portion of the second side member and abuts the supporting surface, the second side channel extending along the second side member and beyond an upper portion of the second side member.

5. The barrier of claim 3, wherein the support member comprises a support channel, at least a portion of the upper wall positioned in the support channel.

6. The barrier of claim 5, wherein the support member is coupled to the backrest panel.

7. The barrier of claim 6, wherein the second side channel is positioned on the second side.

8. The barrier of claim 7, wherein the first side channel, the second side channel, and the upper wall are positioned at a first angle relative to the supporting surface, and wherein the backrest panel is positioned at a second angle relative to the supporting surface.

9. The barrier of claim 8, wherein the support member comprises a retaining channel and a support channel, the retaining channel positioned over the upper edge of the backrest panel and a portion of the upper wall positioned in the support channel.

10. The barrier of claim 9, wherein the retaining channel comprises a first bottom surface adapted to abut the upper edge of the backrest panel, the support channel comprises a second bottom surface adapted to abut the upper wall, the second bottom surface formed at an angle relative to the first bottom surface.

11. A barrier comprising:

a plurality of backrest panels extending in a substantially upward direction relative to a supporting surface on which the barrier is positioned, the plurality of backrest panels having an upper edge remote from the supporting surface;

a first side member coupled to at least one of the plurality of backrest panels and positioned at an angle relative to the plurality of backrest panels, the first side member extending substantially perpendicular to the supporting surface and configured to support the barrier upon the supporting surface;

a second side member spaced from the first side member and positioned at an angle relative to the plurality of backrest panels, the second side member extending substantially perpendicular to the supporting surface and configured to support the barrier upon the supporting surface; and a seat member coupled to the first side member and the second side member and forming a surface substantially parallel with respect to the supporting surface;

a support member secured relative to the plurality of backrest panels and positioned below the upper edge of the plurality of backrest panels;

a first side channel secured to the first side member and extending substantially upward away from the supporting surface and beyond the upper edge of the plurality of backrest panels, the first side channel forming a first channel; and an upper wall having a lower edge, wherein at least a portion of the upper wall is received in the first side channel, at least a portion of the upper wall abuts and is supported by the support member, and the lower edge of the upper wall is positioned below the upper edge of the plurality of backrest panels so that a portion of the upper wall overlaps the plurality of backrest panels.

12. The barrier of claim 11, wherein the support member comprises a support channel, at least a portion of the upper wall positioned in the support channel.

13. The barrier of claim 12, wherein the support member is coupled to at least one of the plurality of backrest panels.

14. The barrier of claim 13, further comprising:

a second side channel secured to the second side member and extending substantially upward away from the supporting surface and beyond the upper edge of the plurality of backrest panels, the second side channel forming a second channel, wherein at least a portion of the upper wall is received in the second side channel, wherein the plurality of backrest panels define a first side and a second side, wherein the seat member is positioned on the first side, and wherein the first side channel, the second side channel, and at least a portion of the upper wall are positioned on the second side.

15. The barrier of claim 14, wherein the first side channel, the second side channel, and the upper wall are positioned at a first angle relative to the supporting surface, and wherein the plurality of backrest panels are positioned at a second angle relative to the supporting surface.

16. The barrier of claim 11, wherein the plurality of backrest panels are arranged side by side between the first side member and the second side member.

17. A barrier comprising:

a backrest panel extending in a substantially upward direction relative to a supporting surface on which the barrier is positioned, the backrest panel having an upper edge remote from the supporting surface;

a first side member coupled to the backrest panel and positioned at an angle relative to the backrest panel, the first side member extending substantially perpendicular to the supporting surface and configured to support the barrier upon the supporting surface;

a second side member spaced from the first side member and positioned at an angle relative to the backrest panel, the second side member extending substantially perpendicular to the supporting surface and configured to support the barrier upon the supporting surface; and a seat member coupled to the first side member and the second side member and forming a surface substantially parallel with respect to the supporting surface;

a support member secured relative to the backrest panel and positioned below the upper edge of the backrest panel;

a first side channel secured to the first side member and extending substantially upward away from the supporting surface and beyond the upper edge of the backrest panel, the first side channel forming a first channel;

a second side channel secured to the second side member and extending substantially upward away from the supporting surface and beyond the upper edge of the backrest panel, the second side channel forming a second channel; and an upper wall having a lower edge, wherein at least a portion of the upper wall is received in the first side channel, at least a portion of the upper wall is received in the second side channel, at least a portion of the upper wall abuts and is supported by the support member, and the lower edge of the upper wall is positioned below the upper edge of the backrest panel so that a portion of the upper wall overlaps the backrest panel.

18. The barrier of claim 17, wherein the support member comprises a support channel, at least a portion of the upper wall positioned in the support channel.

19. The barrier of claim 18, wherein the backrest panel defines a first side and a second side, wherein the seat member is positioned on the first side, and wherein the first side channel, the second side channel, and at least a portion of the upper wall are positioned on the second side.

20. The barrier of claim 19, wherein the first side channel, the second side channel, and the upper wall are positioned at a first angle relative to the supporting surface, and wherein the backrest panel is positioned at a second angle relative to the supporting surface.

* * * * *